US009122197B2

(12) United States Patent
Oda

(10) Patent No.: US 9,122,197 B2
(45) Date of Patent: Sep. 1, 2015

(54) DEVELOPER STORAGE BODY, IMAGE FORMING UNIT AND IMAGE FORMING APPARATUS

(71) Applicant: Oki Data Corporation, Tokyo (JP)

(72) Inventor: Yukiyoshi Oda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/164,857

(22) Filed: Jan. 27, 2014

(65) Prior Publication Data

US 2014/0212182 A1 Jul. 31, 2014

(30) Foreign Application Priority Data

Jan. 28, 2013 (JP) ..... 2013-013121

(51) Int. Cl.
*G03G 15/08* (2006.01)

(52) U.S. Cl.
CPC ..... *G03G 15/0822* (2013.01); *G03G 15/0879* (2013.01)

(58) Field of Classification Search
CPC ..... G03G 15/0839; G03G 2215/0692
USPC ..... 399/262, 263
See application file for complete search history.

(56) References Cited

U.S. PATENT DOCUMENTS

| | | | | |
|---|---|---|---|---|
| 5,235,389 | A * | 8/1993 | Kikuchi et al. | 399/263 |
| 7,046,946 | B2 * | 5/2006 | Sato et al. | 399/260 |
| 8,204,410 | B2 * | 6/2012 | Yamazaki et al. | 399/263 |
| 2008/0292363 | A1 * | 11/2008 | Moon et al. | 399/258 |
| 2009/0169239 | A1 * | 7/2009 | Etter et al. | 399/101 |
| 2009/0238609 | A1 * | 9/2009 | Koido | 399/262 |
| 2011/0064482 | A1 * | 3/2011 | Ishiguro et al. | 399/263 |
| 2011/0222939 | A1 * | 9/2011 | Gibson et al. | 399/358 |

FOREIGN PATENT DOCUMENTS

| | | |
|---|---|---|
| JP | 2006-072145 | 3/2006 |
| JP | 2007-34323 | 2/2007 |
| JP | 2010-237588 A | 10/2010 |

* cited by examiner

*Primary Examiner* — Gregory H Curran
(74) *Attorney, Agent, or Firm* — Rabin & Berdo, P.C.

(57) ABSTRACT

A developer storage body includes a storage portion in which a developer is stored, a supplying opening through which the developer is ejected, and a conveying member provided in the storage portion. The conveying member is rotatable about a rotation axis so as to convey the developer to the supplying opening. The supplying opening is provided with a plurality of slits extending in a direction substantially perpendicular to the rotation axis of the conveying member.

12 Claims, 23 Drawing Sheets

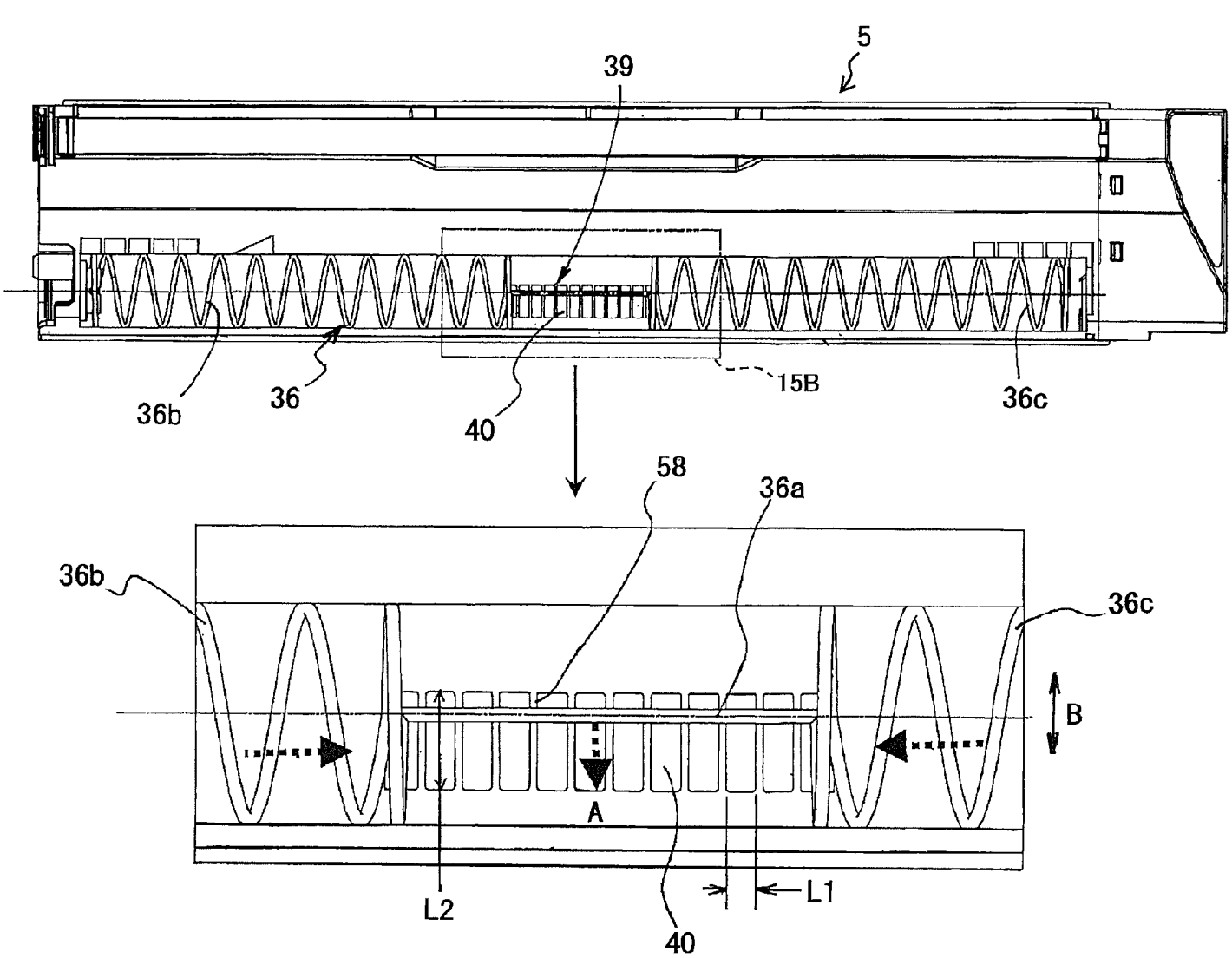
FIG. 15A
FIG. 15B
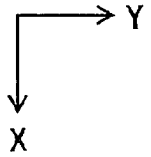

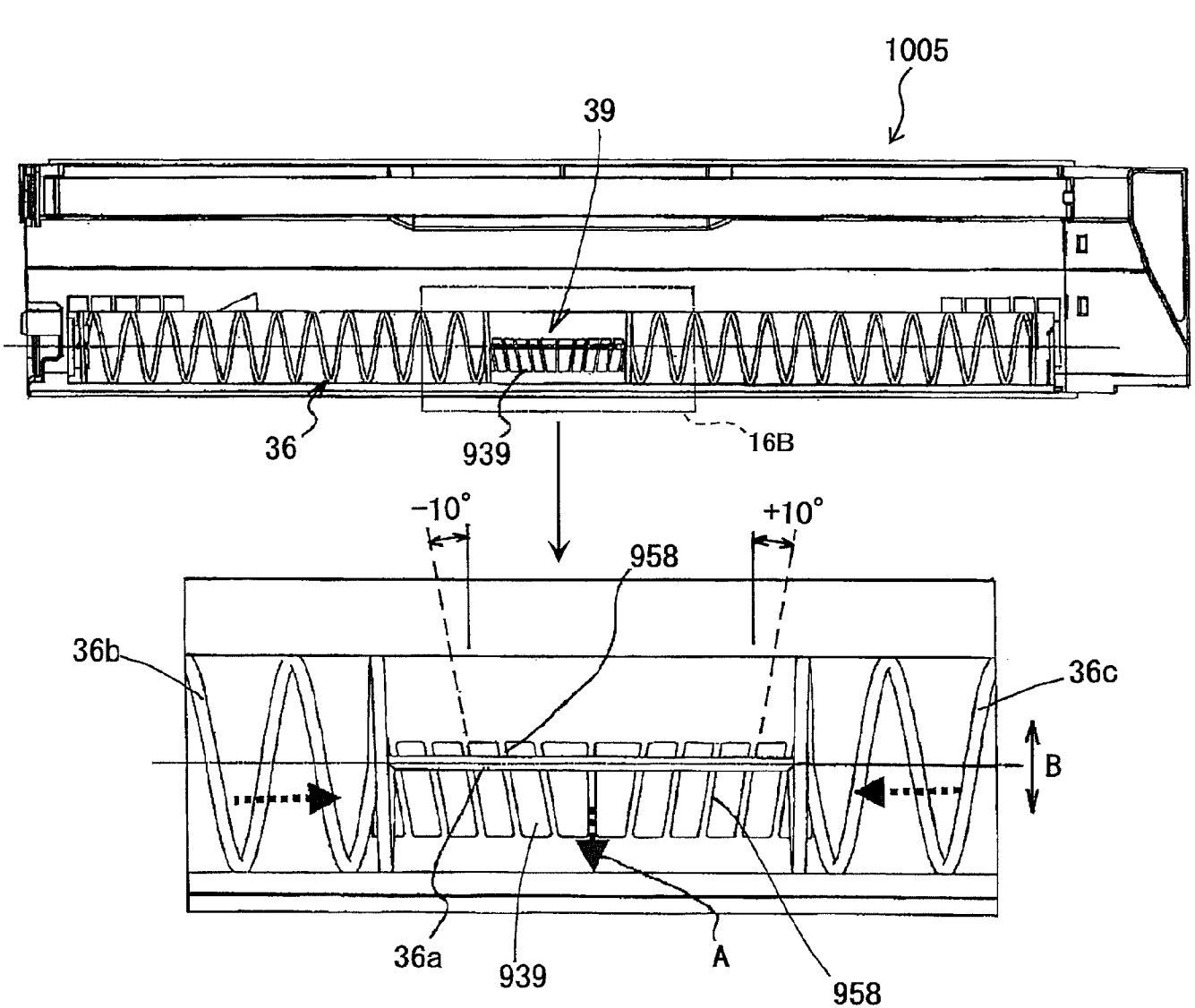
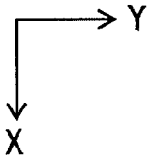
FIG. 16A
FIG. 16B

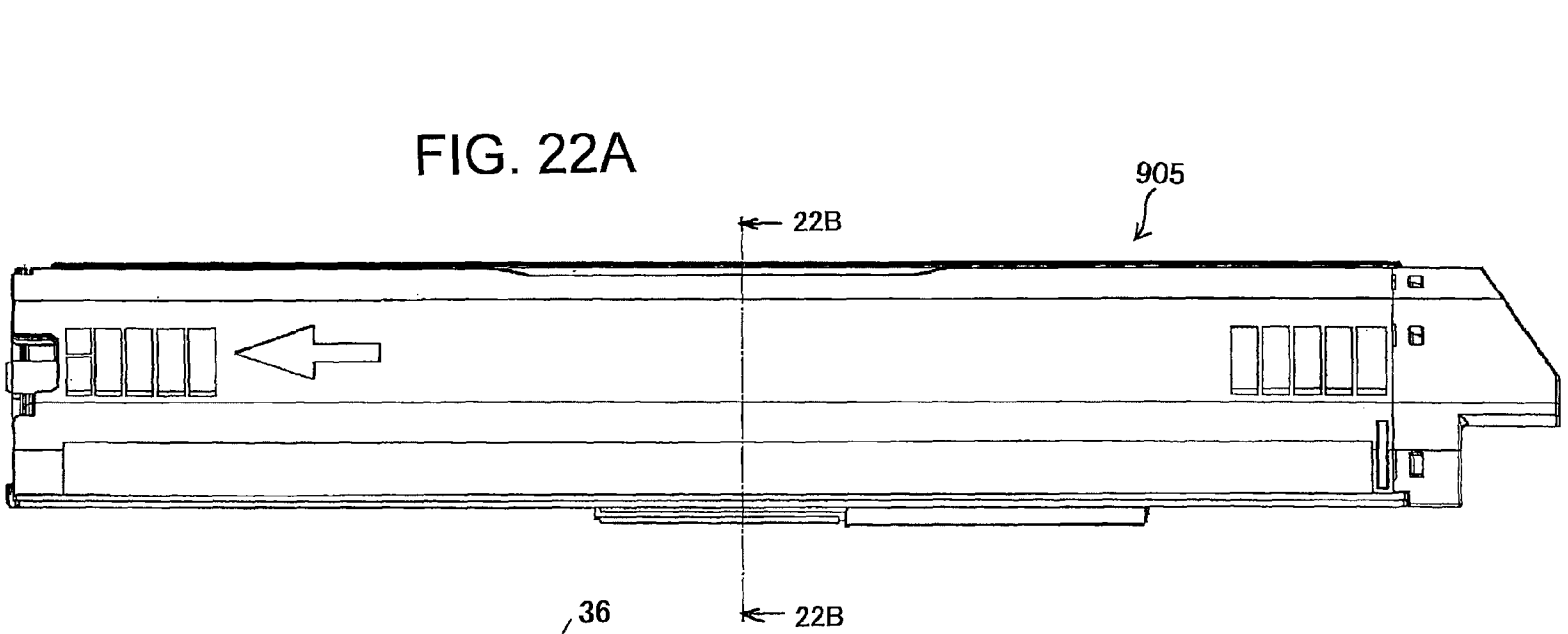
FIG. 22A
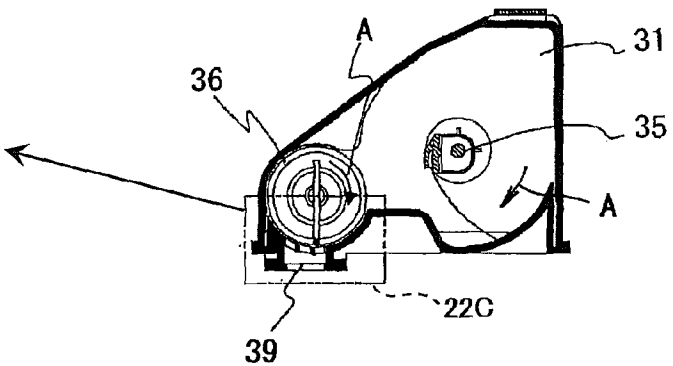
FIG. 22B
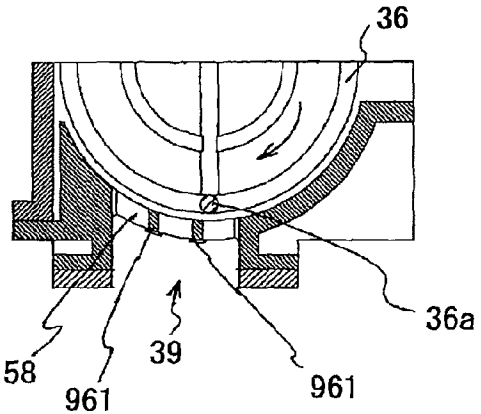
FIG. 22C
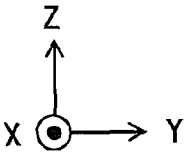

FIG. 26A
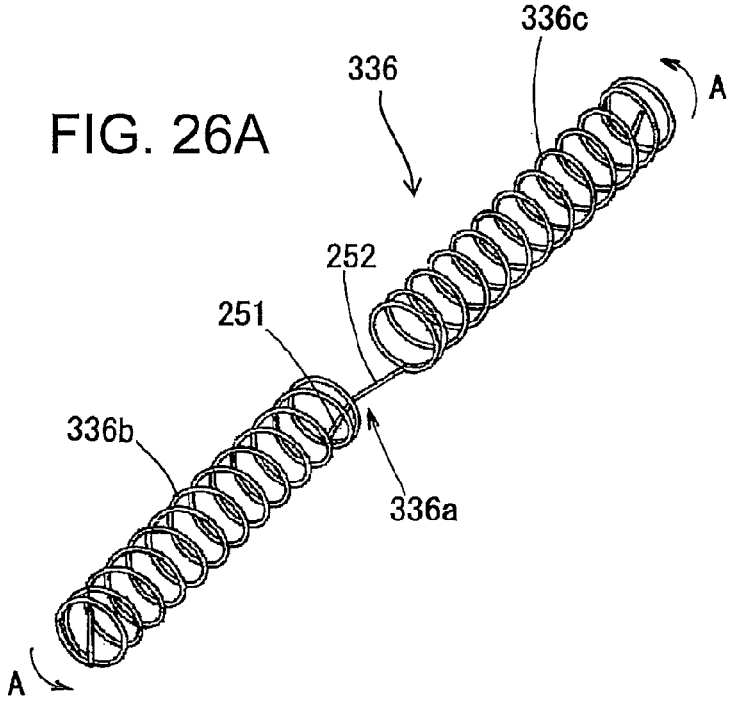
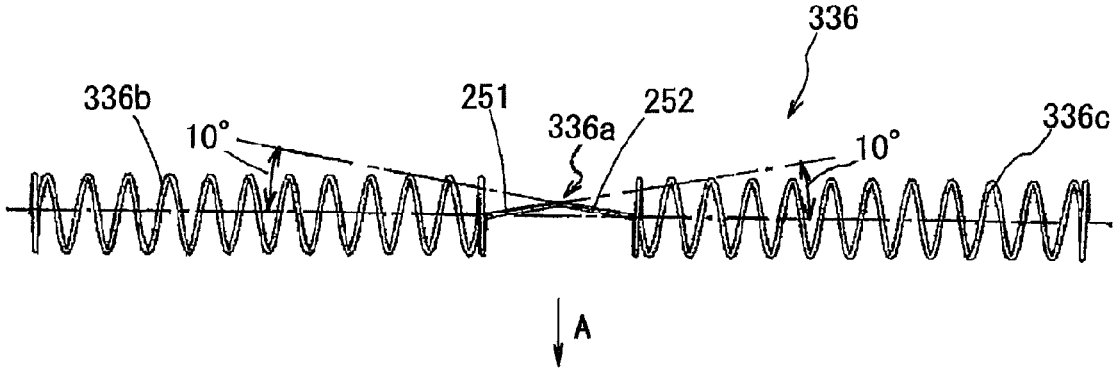
FIG. 26B

FIG. 27A
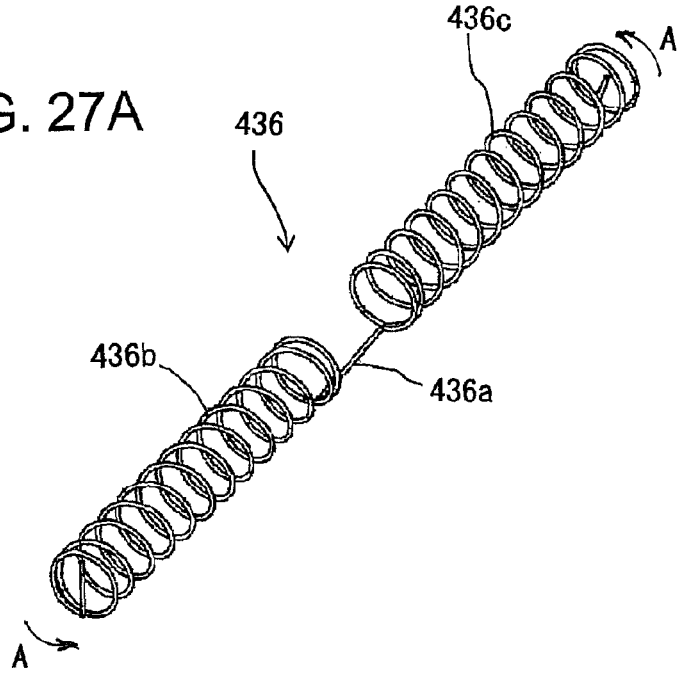
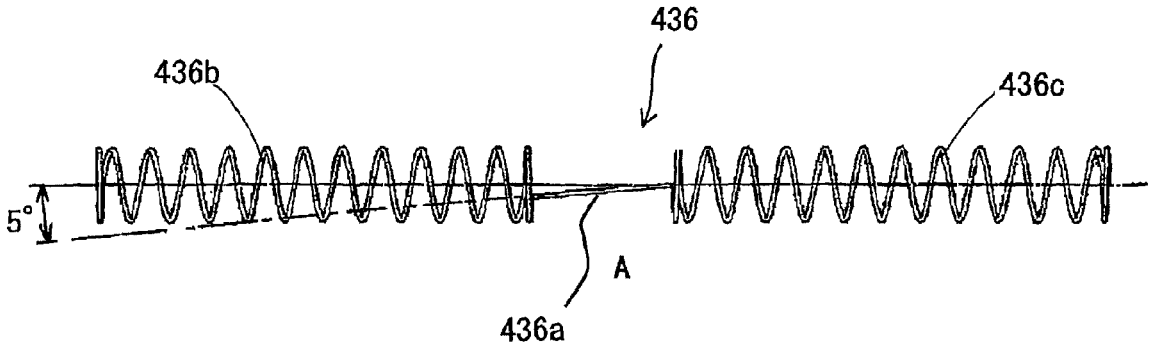
FIG. 27B

DEVELOPER STORAGE BODY, IMAGE FORMING UNIT AND IMAGE FORMING APPARATUS

BACKGROUND OF THE INVENTION

The present invention relates to a developer storage body, an image forming unit and an image forming apparatus such as a printer, a facsimile or a copier.

There is known a developer storage body storing a developer and having a relatively small opening through which the developer is ejected. The developer storage body is externally provided with a slidable shutter for opening and closing the opening (see, Japanese Laid-open Patent Publication No. 2010-237588).

In the conventional developer storage body, a failure in ejection of the developer may occur.

SUMMARY OF THE INVENTION

An aspect of the present invention is intended to provide a developer storage body, an image forming unit and an image forming apparatus capable of suppressing a failure in ejection of a developer.

According to an aspect of the present invention, there is provided a developer storage body including a storage portion in which a developer is stored, a supplying opening through which the developer is ejected, and a conveying member provided in the storage portion. The conveying member is rotatable about a rotation axis so as to convey the developer to the supplying opening. The supplying opening is provided with a plurality of slits extending in a direction substantially perpendicular to the rotation axis of the conveying member.

With such a configuration, it becomes possible to suppress a failure in ejection of a developer.

According to another aspect of the present invention, there is provided an image forming unit including the above described developer storage body.

According to still another aspect of the present invention, there is provided an image forming unit including the above described developer storage body.

Further scope of applicability of the present invention will become apparent from the detailed description given hereinafter. However, it should be understood that the detailed description and specific embodiments, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the attached drawings:

FIG. 15A is a transparent plan view showing the toner cartridge according to Embodiment 1;

FIG. 15B is an enlarged view showing a part surrounded by a dashed line 15B in FIG. 15A;

FIG. 16A is a transparent plan view showing a toner cartridge according to Experimental Example of Embodiment 1;

FIG. 16B is an enlarged view showing a part surrounded by a dashed line 16B in FIG. 16A;

FIG. 22A is a front view showing the toner cartridge according to Comparison Example;

FIG. 22B is a sectional view showing the toner cartridge taken along line 22B-22B in FIG. 22A;

FIG. 22C is an enlarged view showing a part surrounded by a dashed line 22C in FIG. 22B;

FIGS. 26A and 26B are a perspective view and a front view showing a spiral according to Modification 4 of Embodiment 2;

FIGS. 27A and 27B are a perspective view and a front view showing a spiral according to Modification 5 of Embodiment 2.

DETAILED DESCRIPTION OF THE PREFERRED EMBODIMENT

Hereinafter, embodiments of the present invention will be described with reference to drawings.

Embodiment 1

Figure 1:
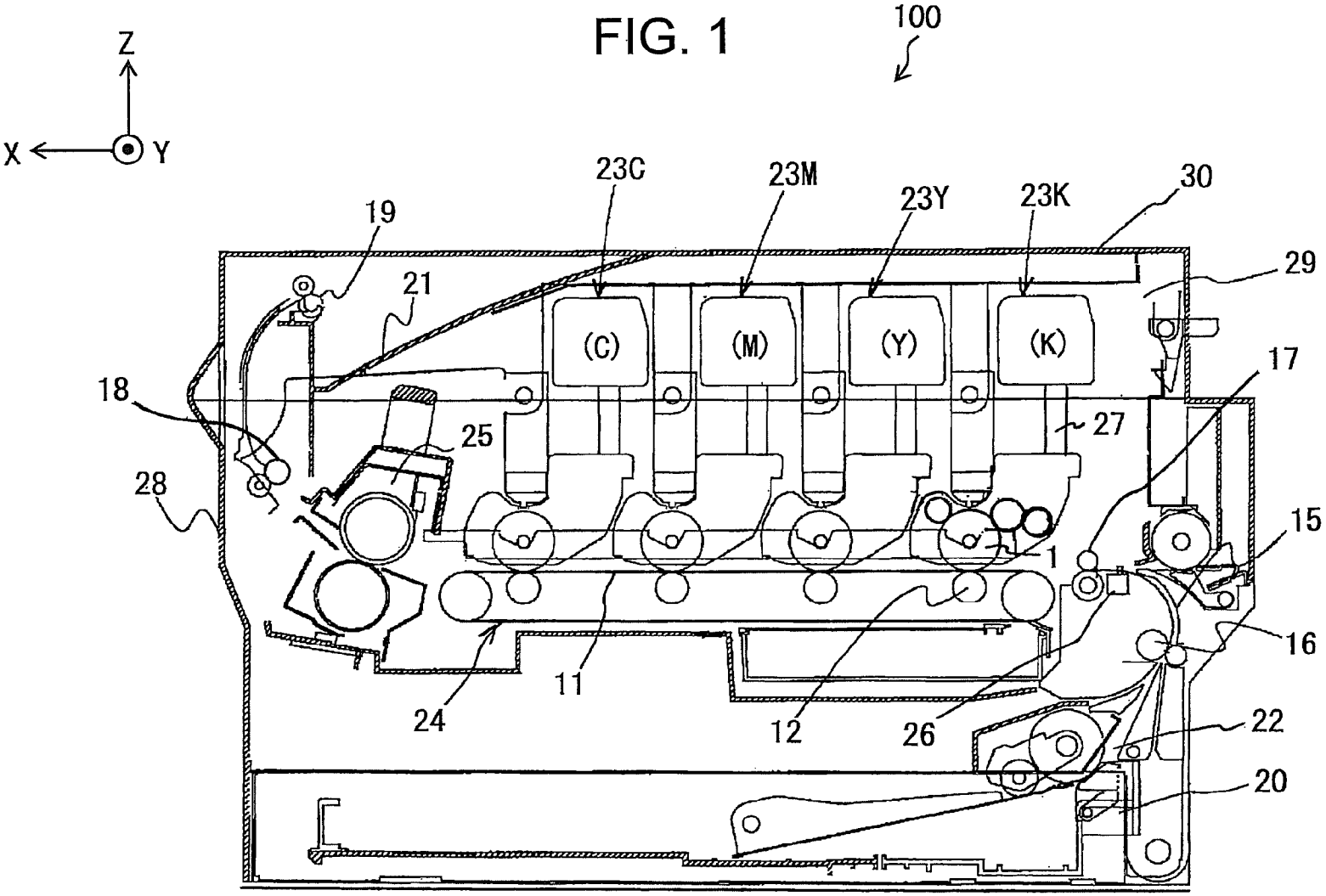
FIG. 1 is a schematic view showing a configuration of a printer including a toner cartridge according to Embodiment 1 of the present invention.

FIG. 1 is a schematic view showing a configuration of a printer 100 including a toner cartridge (i.e., a developer cartridge) according to Embodiment 1 of the present invention.

In FIG. 1, the printer 100 (i.e., an image forming apparatus) is configured as a color electrophotographic printer capable of printing images of black (K), yellow (Y), magenta (M) and cyan (C). The printer 100 includes a lower frame 28 in which a substantially S-shaped sheet transport path 15 (i.e., a medium transport path) is provided. Sheet transport rollers 16, 17, 18 and 19 are disposed along the sheet transport path 15. A feeding cassette 20 is disposed on an upstream end of the sheet transport path 15. The feeding cassette 20 is configured to store recording sheets (i.e., recording media). A stacker 21 is disposed on a downstream end of the sheet transport path 15. The stacker 21 is configured so that the printed recording sheets are placed thereon.

A sheet feeding unit 22, a detection unit 26, a transfer belt unit 24, and a fixing unit 25 are disposed along the sheet transport path 15. The sheet feeding unit 22 is configured to feed the recording sheet from the feeding cassette 20 into the sheet transport path 15. The detection unit 26 is configured to detect a thickness of the recording sheet. The transfer belt unit 24 has a transfer belt 11 that absorbs the recording sheet by electrostatic effect and transports the recording sheet. The fixing unit 25 is configured to fix the toner to the recording sheet.

Image forming units 23K, 23Y, 23M and 23C are disposed on a side (in this example, an upper side) opposite to the transfer belt unit 24 with respect to the recording sheet transported by the transfer belt 11. The image forming units 23K, 23Y, 23M and 23C are provided in a main body of the printer 100, and are arranged in this order from upstream to downstream in a transport direction of the recording sheet. When the image forming units 23K, 23Y, 23M and 23C need not be distinguished from each other, the image forming units 23K, 23Y, 23M and 23C are collectively referred to as the image forming units 23. The image forming units 23K, 23Y, 23M and 23C have the same configurations except toners (developers) stored therein. The configuration of the image forming unit 23 will be herein described. In this regard, a part of the printer 100 from which a detachable component (for example, an image forming unit 23) is detached is referred to as a main body of the printer 100.

In FIG. 1, X direction is defined as the transport direction of the recording sheet when the recording sheet passes the image forming units 23, and Y direction is defined as a direction of a rotation axis of a photosensitive body 1 (described later) of each image forming unit 23. Further, Z direction is defined as a direction perpendicular to both of the X direction and Y direction. In the subsequent drawings, the X direction, the Y direction and the Z direction indicate the same directions as those of FIG. 1. In other words, in the subsequent drawings, the X-axis, the Y-axis and the Z-axis indicate directions of component parts in a state where the component parts are assembled into the printer 100 shown in FIG. 1. Further, in this example, the Z direction is a substantially vertical direction.

Figure 2:
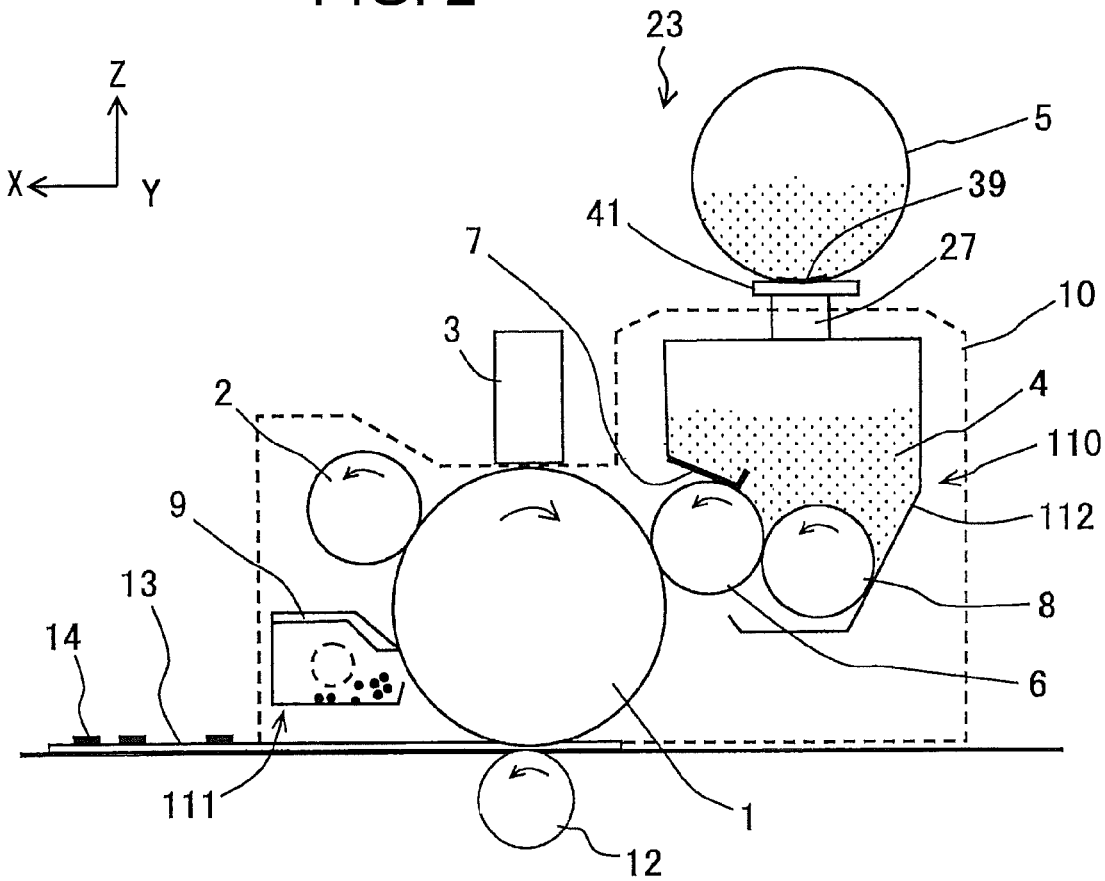
FIG. 2 is a schematic view showing an image forming unit, a transfer roller, an exposure unit and a recording sheet according to Embodiment 1.

FIG. 2 is a schematic view showing the configuration of the image forming unit 23 (i.e., image forming units 23K, 23Y, 23M and 23C), a transfer roller 12, an exposure unit 3 and a recording sheet 13.

As shown in FIG. 2, the image forming unit 23 includes a developing device 10 detachably mounted to the main body of the printer 100, a toner cartridge 5 (i.e., a developer storage body), and a toner cartridge holding unit 41 (i.e., a developer storage body holding unit).

The developing device 10 includes a photosensitive body 1, a charging roller 2, a developing unit 110 and a cleaning blade 9. The photosensitive body 1 has a chargeable surface layer whose charge is removed by exposure. The photosensitive body 1 is rotatable in a direction shown by an arrow. The charging roller 2, an exposure unit 3, the developing unit 110 and the cleaning blade 9 are arranged in this order from upstream to downstream in a rotating direction of the photosensitive body 1.

The charging roller 2 (i.e., a charging member) is pressed against the surface of the photosensitive body 1 by a predetermined pressure, and uniformly charges the surface of the photosensitive body 1. The exposure unit 3 includes, for example, LED (Light Emitting Diode) head as a light source. The exposure unit 3 is configured to emit light so as to irradiate the uniformly charged surface of the photosensitive body 1 so as to form a latent image. The exposure unit 3 is mounted to an upper frame 30 (FIG. 1) of the main body of the printer 100.

The developing unit 110 is configured to develop the latent image formed on the surface of the photosensitive body 1 using a toner 4 (i.e., a developer) of a predetermined color. The cleaning blade 9 is configured to scrape the toner (i.e., a residual toner) remaining on the surface of the photosensitive body 1 after the toner is transferred to the recording sheet 13. The cleaning blade 9 is made of a resilient body. An edge portion of the cleaning blade 9 is pressed against the surface of the photosensitive body 1 by a predetermined pressure. The residual toner scraped by the cleaning blade 9 falls into a waste toner collecting unit 111. The respective rotating bodies (rollers and the like) of the image forming units 23 are driven to rotate by a force transmitted from a driving source (not shown) via gears or the like.

The developing unit 110 is configured to develop the latent image on the surface of the photosensitive body 1. To be more specific, the developing unit 110 includes a toner reservoir 112 (i.e., a developer reservoir), a developing roller 6 (i.e., a developer bearing body), a toner supplying roller 8 (i.e., a developer supplying member) and a developing blade 7 (i.e., a developer regulating member). The toner reservoir 112 is configured to hold the toner 4 ejected from a toner conveying path 27 (i.e., a developer conveying path). The toner supplying roller 8 is configured to supply the toner 4 to the developing roller 6. The developing blade 7 is configured to form a thin layer of the toner 4 (i.e., a toner thin layer) on the surface of the developing roller 6.

The toner cartridge holding unit 41 (described later) is configured to hold the detachable toner cartridge 5 storing the toner 4. The toner cartridge holding unit 41 is configured to guide the toner 4 ejected from a toner supplying opening 39 (i.e., a supplying opening) of the toner cartridge 5 to the toner reservoir 112. In this regard, the toner cartridge holding unit 41 is disposed in the main body of the printer 100 as described later.

The developing roller 6 and the toner supplying roller 8 are disposed in parallel to each other, and are pressed against each other by a predetermined pressure. The developing roller 6 and the toner supplying roller 8 rotate in directions shown by arrows in FIG. 2. The developing blade 7 and the toner supplying roller 8 are disposed parallel to each other. In this example, a bent portion of the developing blade 7 is pressed against the surface of the developing roller 6 by a predetermined pressure.

As shown in FIG. 1, transfer rollers 12 are provided so as to face the respective photosensitive bodies 1 of the four image forming units 23. Each transfer roller 12 has a roller portion made of electric conductive rubber or the like. The transfer rollers 12 are pressed against the respective photosensitive bodies 1 via the transfer belt 11 that absorbs and transports the recording sheet 13 (FIG. 2). Each transfer roller 12 is applied with a transfer voltage so as to form a potential difference between the transfer roller 12 and the surface layer of the photosensitive body 1. With the potential difference, the toner is transferred from the photosensitive body 1 to the recording sheet 13 (FIG. 2).

The fixing unit 25 includes a heat roller and a backup roller. The fixing unit 25 is configured to fix a transferred toner 14 to the recording sheet 13 by application of heat and pressure. The transport rollers 18 and 19 transport the recording sheet 13 (to which the toner image has been fixed) to the stacker 21.

A printing operation of the printer 100 will be described with reference to FIGS. 1 and 2.

When the printing operation is started, the printer 100 causes the sheet feeding unit 22 (FIG. 1) to feed the recording sheet 13 (FIG. 2) from the feeding cassette 20 into the sheet transport path 15. Further, the transport rollers 16 and 17 transport the recording sheet 13 along the sheet transport path 15 to the transfer belt unit 24. The detection unit 26 detects a thickness of the recording sheet 13 transported along the sheet transport path 15. In the transfer belt unit 24, the transfer belt 11 holds the recording sheet 13 by absorption, and transports the recording sheet 13 through the image forming units 23K, 23Y, 23M and 23C. As the recording sheet 13 passes through the image forming units 23K, 23Y, 23M and 23C, toner images (i.e., developer images) are transferred to the recording sheet 13 (FIG. 2) in an overlapping manner. The toner image is fixed to the recording sheet 13 by the fixing unit 25, and the recording sheet 13 (i.e., the printed recording sheet) is transported to the stacker 21.

In the image forming unit 23, the toner 4 replenished from the toner cartridge 5 is supplied by the toner supplying roller 8 to the developing roller 6. The developing blade 7 regulates a thickness of the toner on the surface of the developing roller 6. The developing roller 6 develops the latent image on the surface of the photosensitive body 1 with the toner formed into a thin layer having a uniform thickness. The developed toner image is transferred to the recording sheet 13 by the transfer roller 12. The toner 4 remaining on the surface of the photosensitive body 1 without being transferred to the recording sheet 13 is scraped by the cleaning blade 9, and falls into the waste toner collecting unit 111.

Next, a mechanism for detachably mounting the toner cartridge 5 to the printer 100 will be described.

Figure 3:
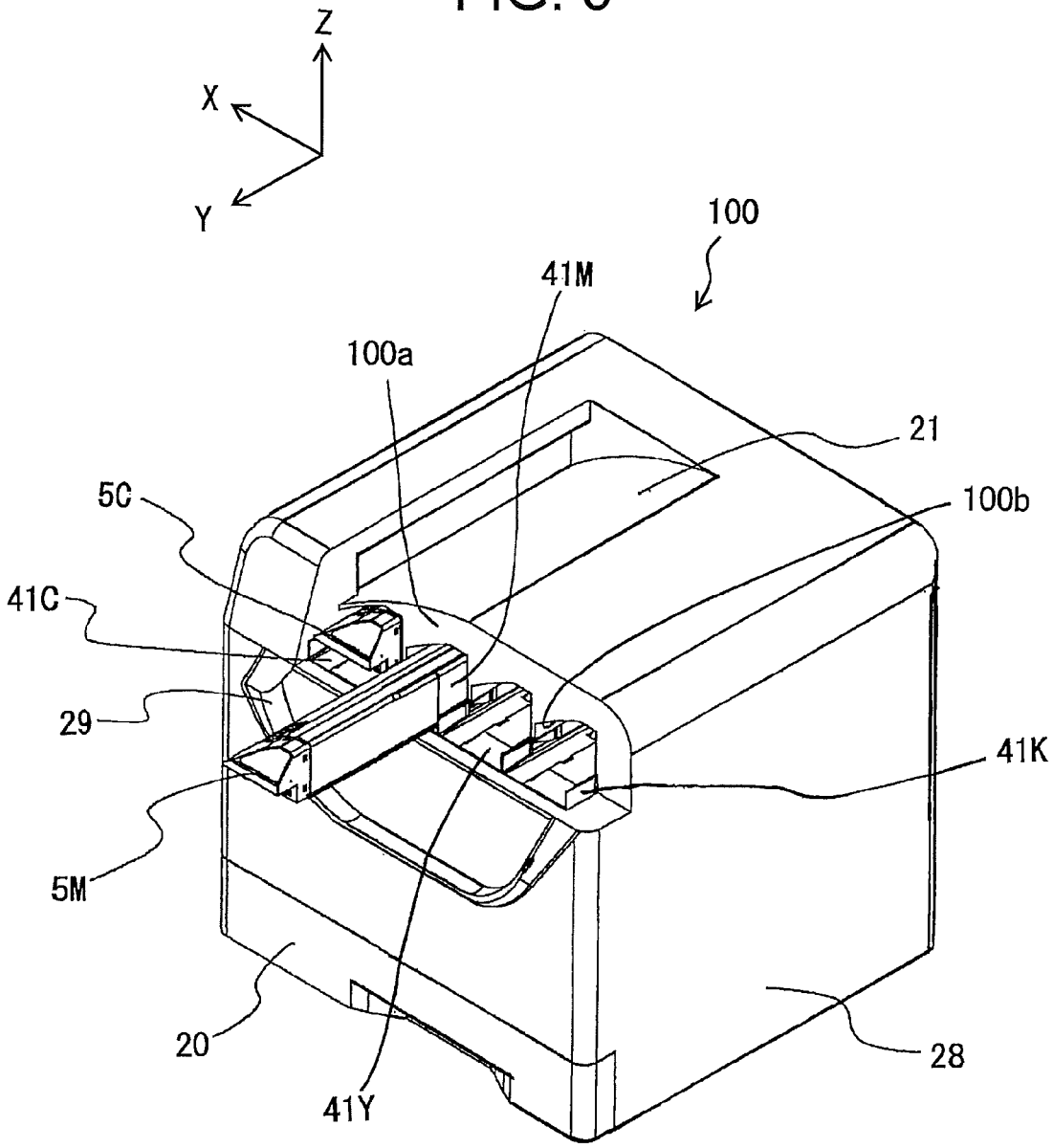
FIG. 3 is a perspective view showing the printer in a state where a front cover is opened.
Figure 4:
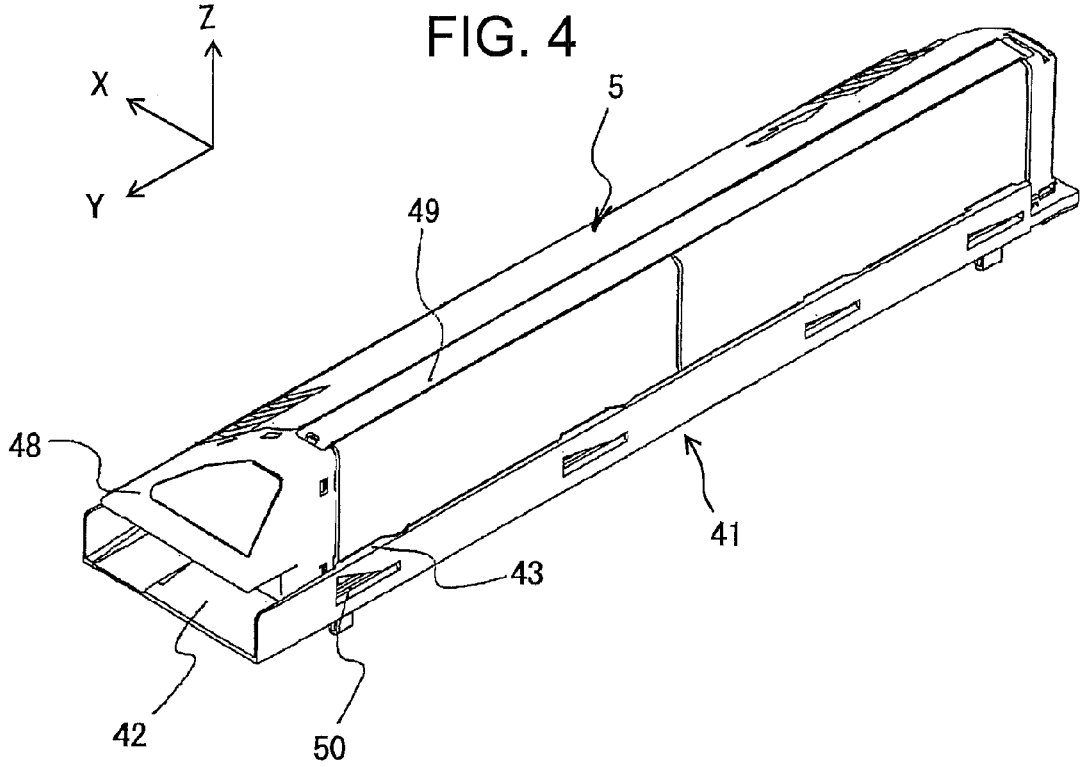
FIG. 4 is a perspective view showing a state where the toner cartridge is mounted to a toner cartridge holding unit of the printer according to Embodiment 1.
Figure 5:
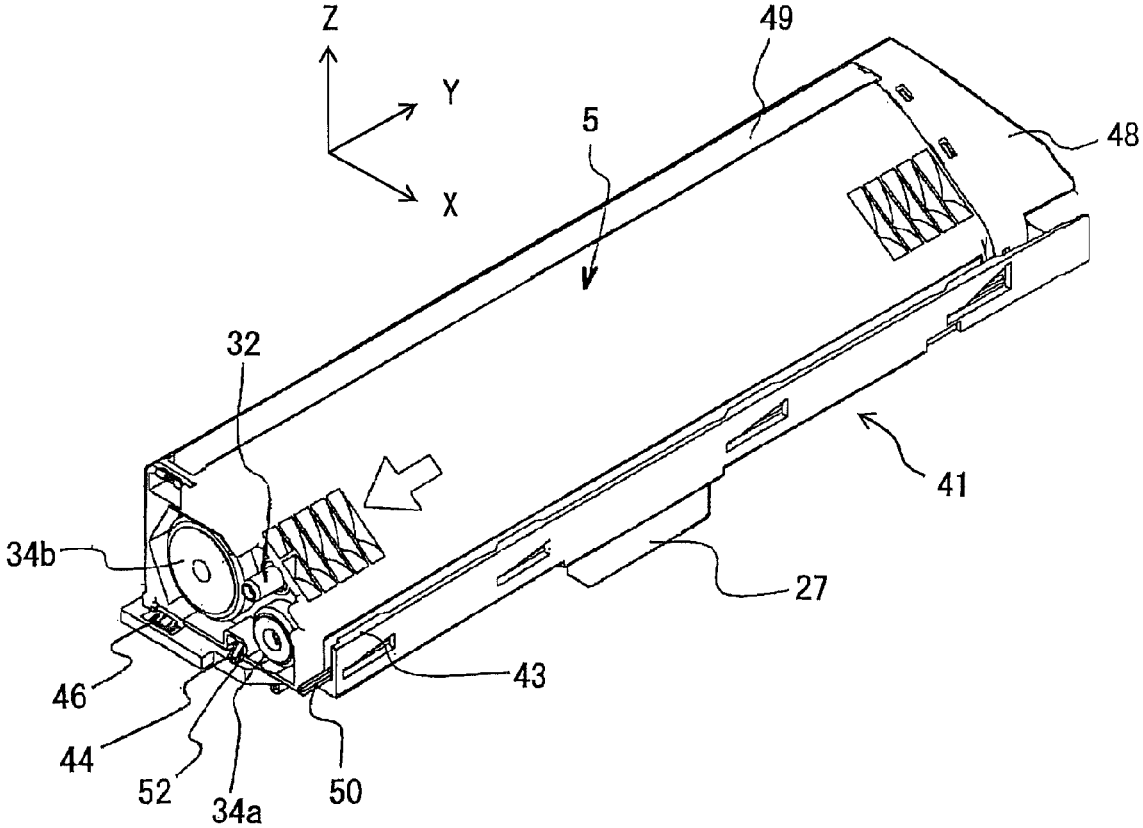
FIG. 5 is a perspective view showing the state where the toner cartridge is mounted to the toner cartridge holding unit of the printer according to Embodiment 1 as seen in a different direction from FIG. 4.
Figure 6:
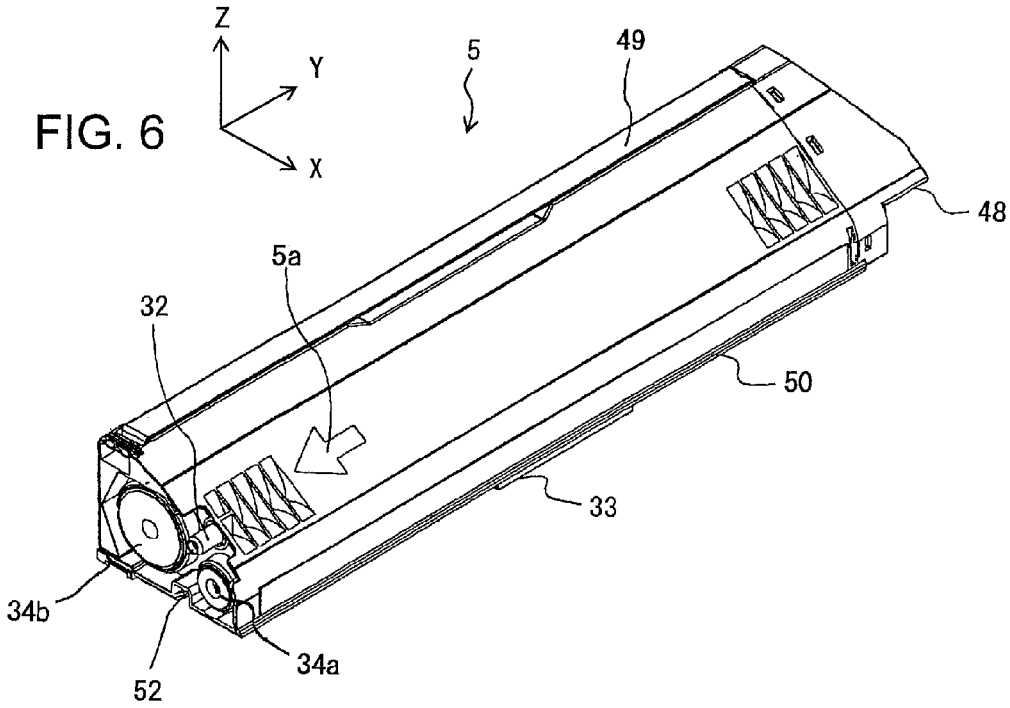
FIG. 6 is a top perspective view showing the toner cartridge according to Embodiment 1.
Figure 7:
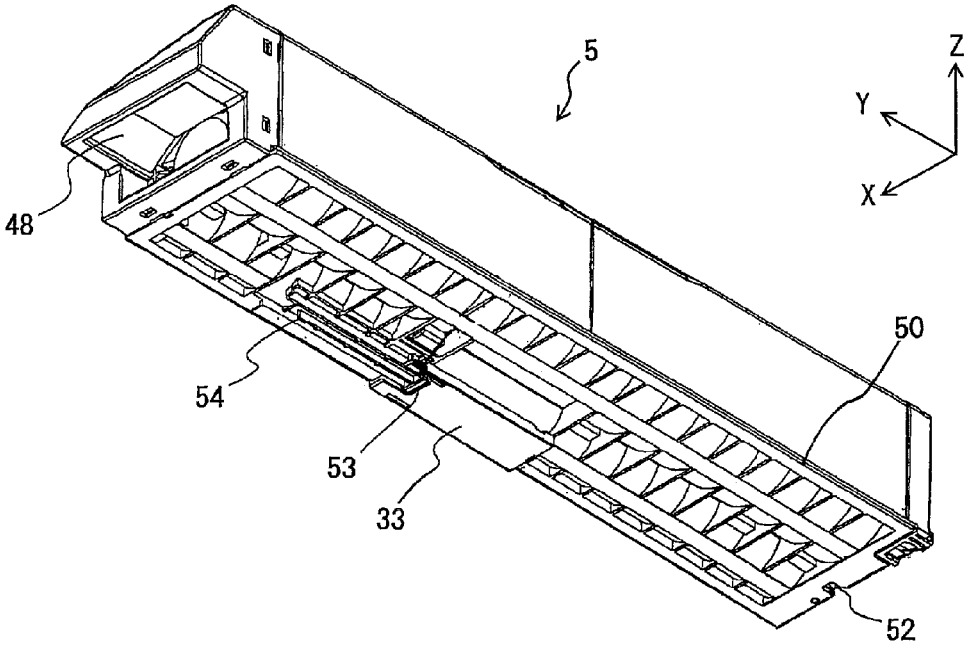
FIG. 7 is a bottom perspective view showing the toner cartridge according to Embodiment 1.
Figure 8:
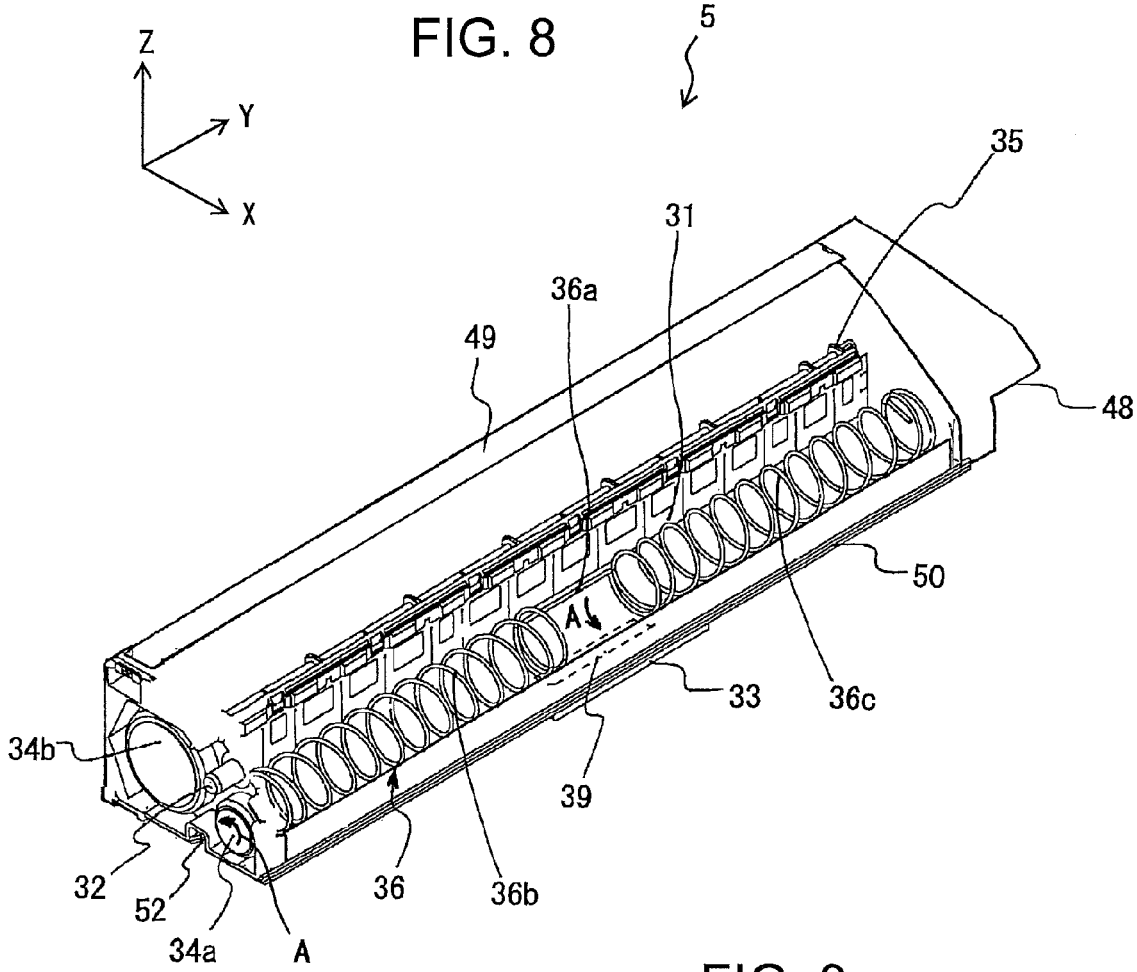
FIG. 8 is a perspective view showing an inner configuration of the toner cartridge according to Embodiment 1 with a cover thereof partially removed.
Figure 9:
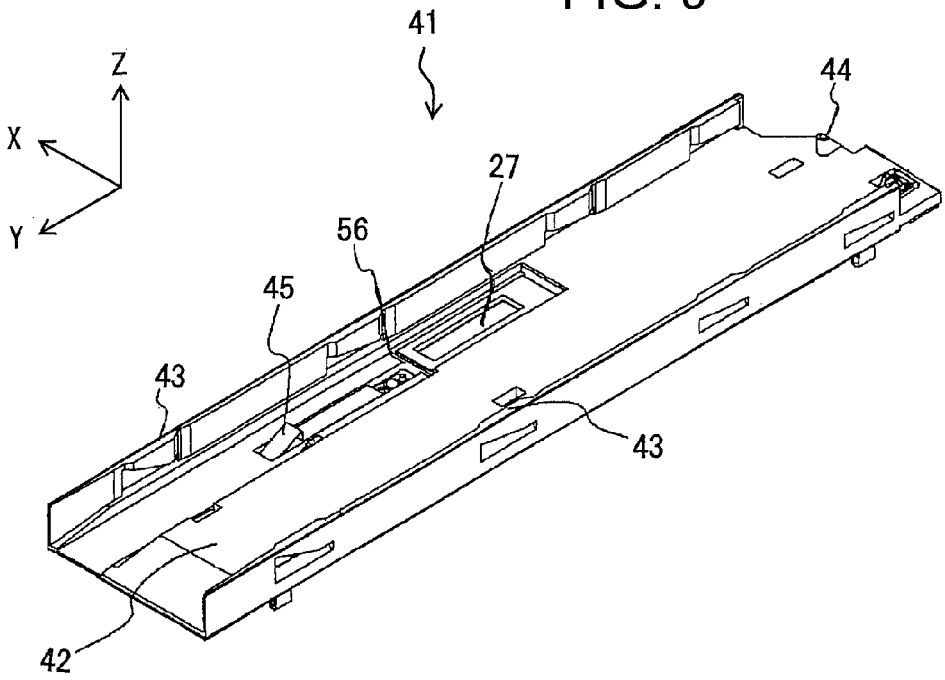
FIG. 9 is a perspective view showing the toner cartridge holding unit according to Embodiment 1.
Figure 10:
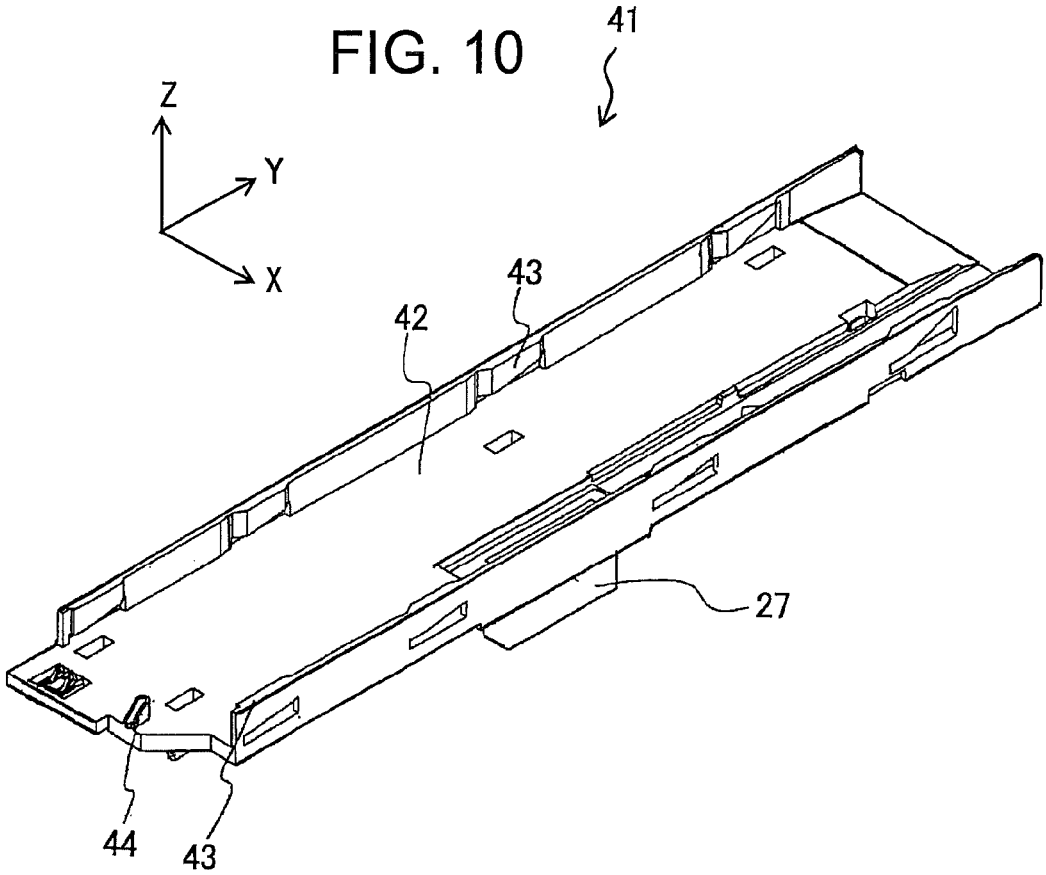
FIG. 10 is a perspective view showing the toner cartridge holding unit according to Embodiment 1 as seen in a different direction from FIG. 9.

FIG. 3 is a perspective view showing the printer 100 in a state where a front cover 92 is opened. FIG. 4 is a perspective view showing the toner cartridge 5 mounted to the toner cartridge holding unit 41 of the printer 100. FIG. 5 is a perspective view showing the toner cartridge 5 mounted to the toner cartridge holding unit 41 of the printer 100 as seen in a different direction from FIG. 4. FIGS. 6 and 7 are a top perspective view and a bottom perspective view showing the toner cartridge 5. FIG. 8 is a perspective view showing an inner configuration of the toner cartridge 5 with a cover thereof partially removed. FIG. 9 is a perspective view showing the toner cartridge holding unit 41. FIG. 10 is a perspective view showing the toner cartridge holding unit 41 as seen in a different direction from FIG. 9.

As shown in FIGS. 1 though 3, the toner cartridge holding units 41 are fixed to the main body of the printer 100. Each toner cartridge holding unit 41 is disposed between the developing device 10 of each image forming unit 23 and the toner cartridge 5. The front cover 29 is provided on an upper part of a front part of the printer 100. The front cover 29 is supported by the main body of the printer 100 so as to be rotatable about a rotation shaft extending in the X direction. The front cover 29 is rotated so as to open and close respective cartridge mounting portions 100*a* (i.e., insertion-removal portions) formed on the main body of the printer 100. Ends of the toner cartridge holding units 41 protrude outside from the cartridge mounting portions 100*a*. The cartridge mounting portions 100*a* have openings 100*b* through which the toner cartridges 5 are mounted (inserted) and detached (removed).

In FIG. 3, four toner cartridge holding units 41 (41K, 41Y, 41M and 41C) are arranged in the X direction. Among the four toner cartridge holding units 41, the toner cartridge 5C is mounted to the toner cartridge holding unit 41C. The toner cartridge 5M is being mounted to the toner cartridge holding unit 41M. No toner cartridge is mounted to the toner cartridge holding units 41Y and 41K.

FIGS. 4 and 5 are perspective views showing a state where the toner cartridge 5 is mounted to the toner cartridge holding unit 41 (like the toner cartridge holding unit 41C in FIG. 3). In this state, the toner cartridge holding unit 41 and the toner cartridge 5 extend in the Y direction in the main body of the printer 100. Hereinafter, a longitudinal direction of the toner cartridge holding unit 41 and a longitudinal direction of the toner cartridge 5 indicate the Y direction.

As shown in FIGS. 6, 7 and 8, the toner cartridge 5 includes a toner storage portion 31 (i.e., a storage portion) in which the toner 4 is stored, a toner supplying opening 39 (i.e., a supplying opening) through which the toner is ejected from the toner storage portion 31, and a shutter 33 (i.e., an opening-and-closing member) for opening and closing the toner supplying opening 39. The toner supplying opening 39 is disposed at a bottom of the toner storage portion 31. The shutter 33 is slidable in a longitudinal direction of the toner cartridge 5.

The toner cartridge 5 further includes a positioning post 32, a regulating groove portion 52, external ribs 50, gears 34*a* and 34*b*, a spiral 36 (i.e., a conveying member), an agitating member 35, a grip portion 49, and a handle portion 48.

The positioning post 32 fits into a fitting hole (described later) formed on a driving input gear 37 (FIG. 11) provided on the main body of the printer 100 so as to determine a position of the toner cartridge 5 with respect to the toner cartridge holding unit 41. The regulating groove portion 52 engages a positioning portion 44 (described later) of the toner cartridge holding unit 41 to prevent a rotation of the toner cartridge 5. The external ribs 50 slides on guide members 43 (described later) of the toner cartridge holding unit 41 so as to allow the toner cartridge 5 to be slidable with respect to the toner cartridge holding unit 41. The gears 34*a* and 34*b* mesh with the driving input gear 37 (FIG. 11) and receive a driving force.

The spiral 36 rotates together with the gear 34*a* to convey the toner 4 toward the toner supplying opening 39. The agitating member 35 rotates together with the gear 34*b* to agitate the toner 4. The grip portion 49 is gripped by a user when the user holds the toner cartridge 5. The handle portion is operated by the user when the user pulls the toner cartridge 5 from the main body of the printer 100. In this regard, FIG. 7 shows the toner cartridge 5 in a state where the shutter 33 closes the toner supplying opening 39.

Here, the toner supplying opening 39 is disposed at a substantially center portion of the toner cartridge 5 in the longitudinal direction. The toner supplying opening 39 is provided with ribs 58 (FIG. 13B) as described later. Further, an arrow 5*a* is provided on an external surface of the toner cartridge 5. The arrow 5*a* indicates a mounting direction (i.e., an inserting direction) of the toner cartridge 5.

As shown in FIGS. 9 and 10, the toner cartridge holding unit 41 includes a tray 42, the guide members 43, the positioning portion 44, a latch 45, a shutter movement restricting portion 56, and the toner conveying path 27. The tray 42 is configured so that the toner cartridge 5 is placed thereon. The guide members 43 slidably contact the external ribs 50 of the toner cartridge 5 so as to guide the toner cartridge 5 when the toner cartridge 5 moves (slides) on the tray 42. The positioning portion 44 engages the groove portion 52 of the toner cartridge 5 so as to prevent the rotation of the toner cartridge 5 and restrict an insertion amount of the toner cartridge 5. The latch 45 engages a rear end portion of the shutter 33 so as to move the shutter 33 when the toner cartridge 5 is pulled out (removed). The shutter movement restricting portion 56 engages the shutter 33 upon insertion of the toner cartridge 5 so as to restrict the movement of the shutter 33 in the inserting direction of the toner cartridge 5. The toner conveying path 27 (i.e., a developer receiving portion) is provided for conveying the toner 4 ejected from the toner supplying opening 39 of the toner cartridge 5 to the toner reservoir 112 of the developing device 10.

An inserting operation of the toner cartridge 5 into the main body of the printer 100 will be described.

As shown in FIG. 3, when the user opens the front cover 29 of the printer 100, ends of four toner cartridge holding units 41 protruding from the opening 100*b* appear. The user places an end portion of the toner cartridge 5 in the direction indicated by the arrow 5*a* (FIG. 6) on the tray 42 (FIG. 9), and inserts the toner cartridge 5 in such a manner that the external ribs 50 (FIG. 6) slide on the guide members 43. In this state, the toner cartridge 5 slides on the tray 42 (FIG. 9) in −Y direction.

During the insertion of the toner cartridge 5, the shutter 33 presses the latch 45 (formed of a resilient member) causing the latch 45 to be deformed. Then, the shutter 33 contacts the shutter movement restricting portion 56, and a further movement of the shutter 33 is restricted. When the toner cartridge 5 is further inserted, the shutter 33 (contacting the shutter movement restricting portion 56) relatively moves with respect to the toner cartridge 5 to start opening the toner supplying opening 39 (FIG. 8).

Figure 11:
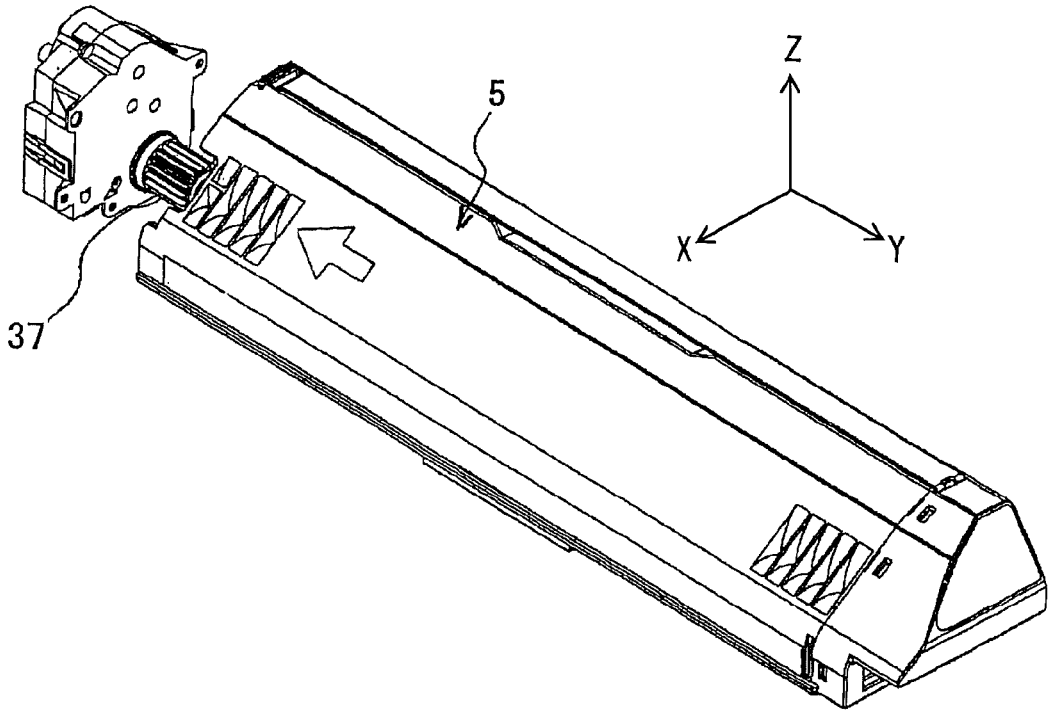
FIG. 11 is a perspective view showing a state where a driving input gear of a main body of the printer and a gear of the toner cartridge according to Embodiment 1.

When the toner cartridge 5 is further inserted, the positioning post 32 (FIG. 6) fits into the fitting hole (not shown) formed on a center portion (i.e., a rotation center) of the driving input gear 37 as shown in FIG. 11. At the same time, the positioning portion 44 (FIG. 9) of the toner cartridge holding unit 41 engages the groove portion 52 (FIG. 7) of the toner cartridge 5. Therefore, the position of the toner cartridge 5 is determined with respect to the toner cartridge holding unit 41. In this state, the driving input gear 37 meshes with the gears 34*a* and 34*b* of the toner cartridge 5.

In this state, the latch 45 is released from being pressed, and engages the rear end portion of the shutter 33. The latch 45 also engages a latch-engaging portion (not shown) formed on the main body of the toner cartridge 5. Therefore, the shutter 33 and the toner cartridge 5 are prevented from moving in +Y direction. In other words, the toner cartridge 5 is retained on the toner cartridge holding unit 41 so as not to be dropped, and the toner supplying opening 39 is kept opened. A position of the toner cartridge 5 whose toner supplying opening 39 (FIG. 8) is opened is referred to as a mounting position.

A configuration of the toner cartridge 5 will be further described.

Figure 12:
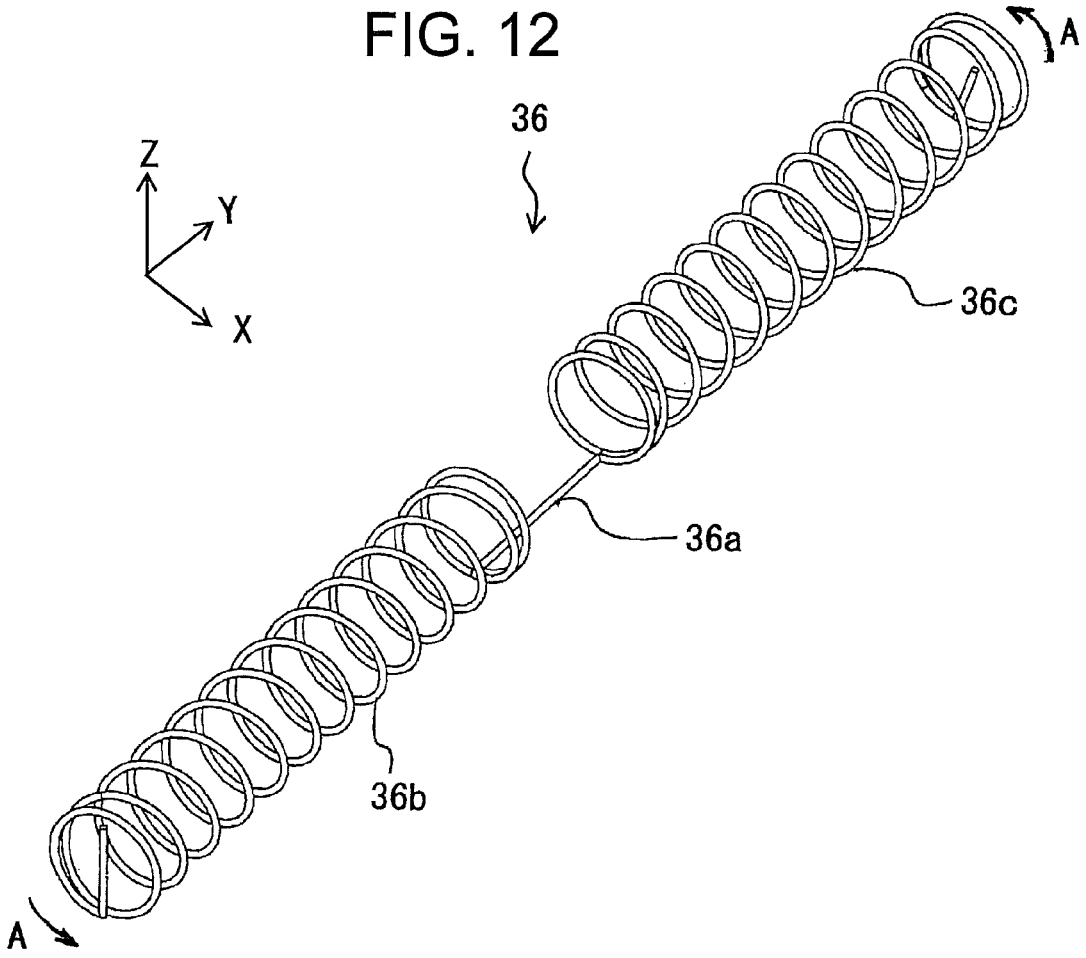
FIG. 12 is a perspective view showing a spiral provided in a toner storage portion of the toner cartridge according to Embodiment 1.

FIG. 12 is a perspective view showing the spiral 36 (i.e., the conveying member) disposed in the toner storage portion 31 of the toner cartridge 5 as shown in FIG. 8. As shown in FIG. 12, the spiral 36 is configured so that two main parts are symmetrical with each other with respect to an imaginary plane therebetween perpendicular to an axial direction of the spiral 36. The spiral 36 includes an agitating portion 36*a* extending in the axial direction. The agitating portion 36*a* is disposed at a center portion of the spiral 36. The agitating portion 36*a* extends along an imaginary cylindrical surface whose diameter is the same as an outer diameter of the spiral 36. Further, the agitating portion 36*a* is in the form of a bar. The spiral 36 further includes a left spiral portion 36*b* and a right spiral portion 36*c* (i.e., conveying portions) connected to both ends of the agitating portion 36*a*. The left spiral portion 36*b* and the right spiral portion 36*c* have spiral shapes. The left spiral portion 36*b* and the right spiral portion 36*c* are wound in opposite directions.

When the spiral 36 is mounted to a predetermined position in the toner storage portion 31 as shown in FIG. 8, an end of the left spiral portion 36*b* is fixed to the gear 34*a*. In this state, the agitating portion 36*a* of the spiral 36 faces the toner supplying opening 39 from above. The toner supplying opening 39 is formed on a bottom of the toner storage portion 31, and is disposed at a substantially center portion of the toner storage portion 31. The spiral 36 rotates together with the gear 34*a* in such a manner that the agitating portion 36*a* moves in proximity to or in contact with a bottom inner circumferential surface 38 (FIG. 14C) of the toner storage portion 31. The bottom inner circumferential surface 38 has an arcuate cross section, and is formed on a bottom of the toner storage portion 31. A direction of the rotation axis of the spiral 36 is parallel to the longitudinal direction of the toner cartridge 5 (i.e., the Y direction).

Therefore, when the driving input gear 37 (meshing with the gear 34*a*) rotates in a predetermined direction, the spiral 36 rotates in a direction shown by an arrow A (FIG. 12) in the toner storage portion 31. As the spiral 36 rotates in the direction shown by the arrow A, the left and right spiral portions 36*b* and 36*c* conveys the toner 4 toward the center portion (i.e., the toner supplying opening 39). To be more specific, the left spiral portion 36*b* conveys the toner 4 in +Y direction toward the toner supplying opening 39, and the right spiral portion 36*c* conveys the toner 4 in −Y direction toward the toner supplying opening 39. The spiral 36 is made of, for example, a metal wire. To be more specific, the spiral 36 is made of, for example, a stainless steel (more specifically, SUS 304-WPB).

Figures 13A, 13B:
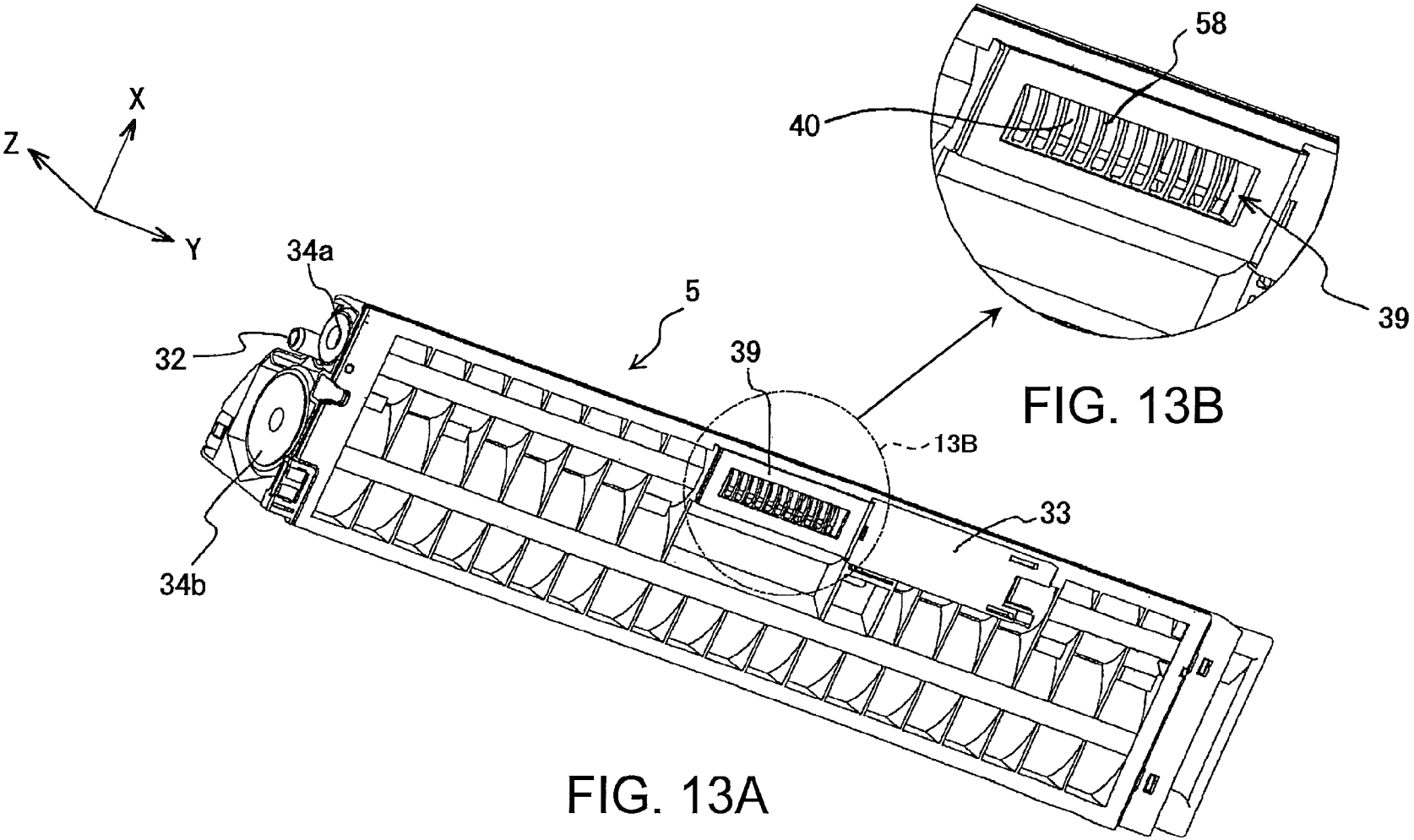
FIG. 13A is a bottom perspective view showing the toner cartridge according to Embodiment 1 in a state where a toner supplying opening is opened.
FIG. 13B is an enlarged view showing a part surrounded by a dashed line 13B in FIG. 13A.
Figures 14A, 14B, 14C:
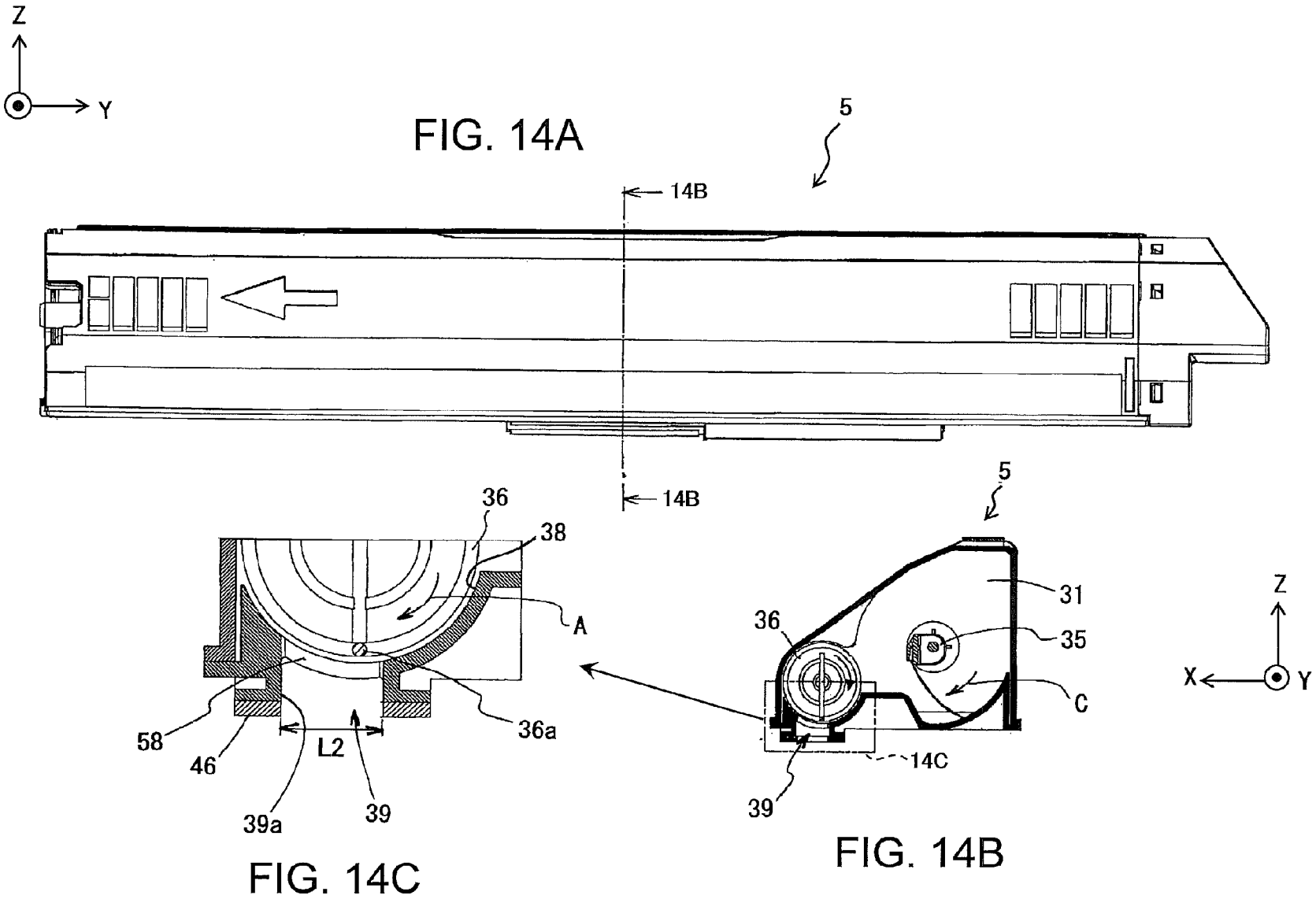
FIG. 14A is a front view showing the toner cartridge according to Embodiment 1.
FIG. 14B is a sectional view showing the toner cartridge taken along line 14B-14B in FIG. 14A.
FIG. 14C is an enlarged view showing a part surrounded by a dashed line 14C in FIG. 14B.

FIG. 13A is a bottom perspective view showing the toner cartridge 5 in a state where the toner supplying opening 39 is opened. FIG. 13B is an enlarged view showing a part surrounded by a dashed line 13B in FIG. 13A. FIG. 14A is a front view showing the toner cartridge 5. FIG. 14B is a sectional view showing the toner cartridge 5 taken along line 14B-14B in FIG. 14A. FIG. 14C is an enlarged view showing a part surrounded by a dashed line 14C in FIG. 14B. FIG. 15A is a transparent plan view showing the toner cartridge 5. FIG. 15B is an enlarged view showing a part surrounded by a dashed line 15B in FIG. 15A.

The toner supplying opening 39 is disposed at the substantially center portion of the toner cartridge 5 in the longitudinal direction of the toner cartridge 5. The toner supplying opening 39 has an opening area 39*a* (FIG. 14C) having a rectangular shape elongated in the longitudinal direction of the toner cartridge 5 (see FIGS. 13A, 13B and 15A). Further, as shown in FIG. 14C, the toner supplying opening 39 has a depth to reach from the bottom inner circumferential surface 38 to a connecting portion 46 connected to the toner cartridge holding unit 41 (FIG. 9).

The toner supplying opening 39 is provided with a plurality of ribs 58 as shown in FIGS. 13B and 14C. The ribs 58 are disposed at a region in the toner supplying opening 39 on the same side as the bottom inner circumferential surface 38. The ribs 58 are disposed at a predetermined interval in the direction of the rotation axis of the spiral 36. The ribs 58 extend in a direction perpendicular to the rotation axis of the spiral 36 so that inner ends of the ribs 58 are aligned with the bottom inner circumferential surface 38. A plurality of slits 40 are formed between the ribs 58. The slits 40 extend in the direction perpendicular to the rotation axis of the spiral 36, and are disposed at a predetermined interval in the direction of the rotation axis of the spiral 36.

As shown in FIG. 15B, each slits 40 has an opening area in the form of an elongated rectangle along the bottom inner circumferential surface 38. In FIG. 15B, L1 indicates a length of a shorter edge (i.e., a slit width) of each slit 40 in the direction of the rotation axis of the spiral 36. L2 indicates a length of an arcuate longer edge (i.e., an edge on a plane perpendicular to the rotation axis of the spiral 36) of each slit 40. The ribs 58 are formed so that the length L1 of the shorter edge is shorter than the length L2 of the longer edge (i.e., L1<L2). For example, the length L1 of the shorter edge is preferably in a range from 4 mm to 6 mm, and the length L2 of the longer edge is preferably in a range from 10 mm to 15 mm. Further, a width d of each rib 58 in the direction of the rotation axis of the spiral 36 is preferably in a range from 1 mm to 2 mm.

The agitating portion 36*a* is disposed at a position facing the slits 40 of the toner storage portion 31. The left spiral portion 36*b* and the right spiral portion 36*c* (i.e., conveying portions) are disposed at positions that do not face the slits 40 of the toner storage portion 31.

Hereinafter, description will be made of an operation in which the toner 4 is supplied from the toner storage portion 31 of the toner cartridge 5 to the toner conveying path 27 (leading to the toner reservoir 112 of the developing device 10 shown in FIG. 2) via the toner supplying opening 39 with reference to FIGS. 2, 8, 13A through 15B.

As shown in FIG. 14B, when the agitating member 35 rotates in a direction shown by an arrow C, the toner 4 stored in the toner storage portion 31 of the toner cartridge 5 is conveyed toward the spiral 36. The toner 4 is then conveyed from both sides toward the toner supplying opening 39 at the center portion by the left spiral portion 36*b* and the right spiral portion 36*c* of the spiral 36 rotating in the direction shown by the arrow A in FIG. 8. In this state, a conveying direction of the toner 4 is the same as the direction of the rotation axis of the spiral 36.

Since the toner supplying opening 39 extends downward, the toner 4 conveyed by the spiral 36 to the vicinity of the toner storage opening 39 is introduced into the toner supplying opening 39 by gravity of the toner 4 or by conveying forces of the left and right spiral portions 36*b* and 36*c*. The toner 4 which has not been introduced into the toner supplying opening 39 is moved by the agitating portion 36*a* in a rotating direction of the spiral 36. The agitating portion 36*a* agitates the toner 4 by changing the conveying direction of the toner 4. The agitating portion 36*a* rotates in proximity to or in contact with an inner circumferential surface of the toner storage portion 31, and conveys the toner 4 toward the toner supplying opening 39.

As the spiral 36 rotates to convey the toner 4 toward the toner storage opening 39, an excessive amount of the toner 4 may be collected at the toner supplying opening 39. In such a case, a pressure applied to the toner 4 may increase, and a part of the toner 4 may be agglomerated. However, in Embodiment 1, the ribs 58 provided in the toner supplying opening 39 prevents agglomeration of the toner 4.

As shown in FIGS. 14C and 15B, the ribs 58 are provided along the inner circumferential surface of the toner storage portion 31. Further, the ribs 58 extend in a direction perpendicular to the agitating portion 36*a* that moves in proximity to or in contact with the inner circumferential surface of the toner storage portion 31. Therefore, when the agitating portion 36*a* rotates to convey the toner 4 toward the toner supplying opening 39, the agitating portion 36*a* rotates in proximity to or in contact with the ribs 58. Accordingly, the agitating portion 36*a* loosens the agglomerated toner and conveys the toner into the toner supplying opening 39 via the slits 40. The toner 4 introduced into the toner storage opening 39 passes the toner conveying path 27, and is stored in the toner reservoir 112 (FIG. 2) of the developing device 10. Since the agglomerated toner 4 is loosened at the toner supplying opening 39 of the toner cartridge 5, the non-agglomerated toner is stably supplied to the developing device 10.

Here, a toner cartridge 905 of Comparison Example will be described. In the toner cartridge 905 of Comparison Example, the toner supplying opening 39 has ribs 961 extending in the direction parallel to the rotation axis of the spiral 36.

Figures 21A, 21B:
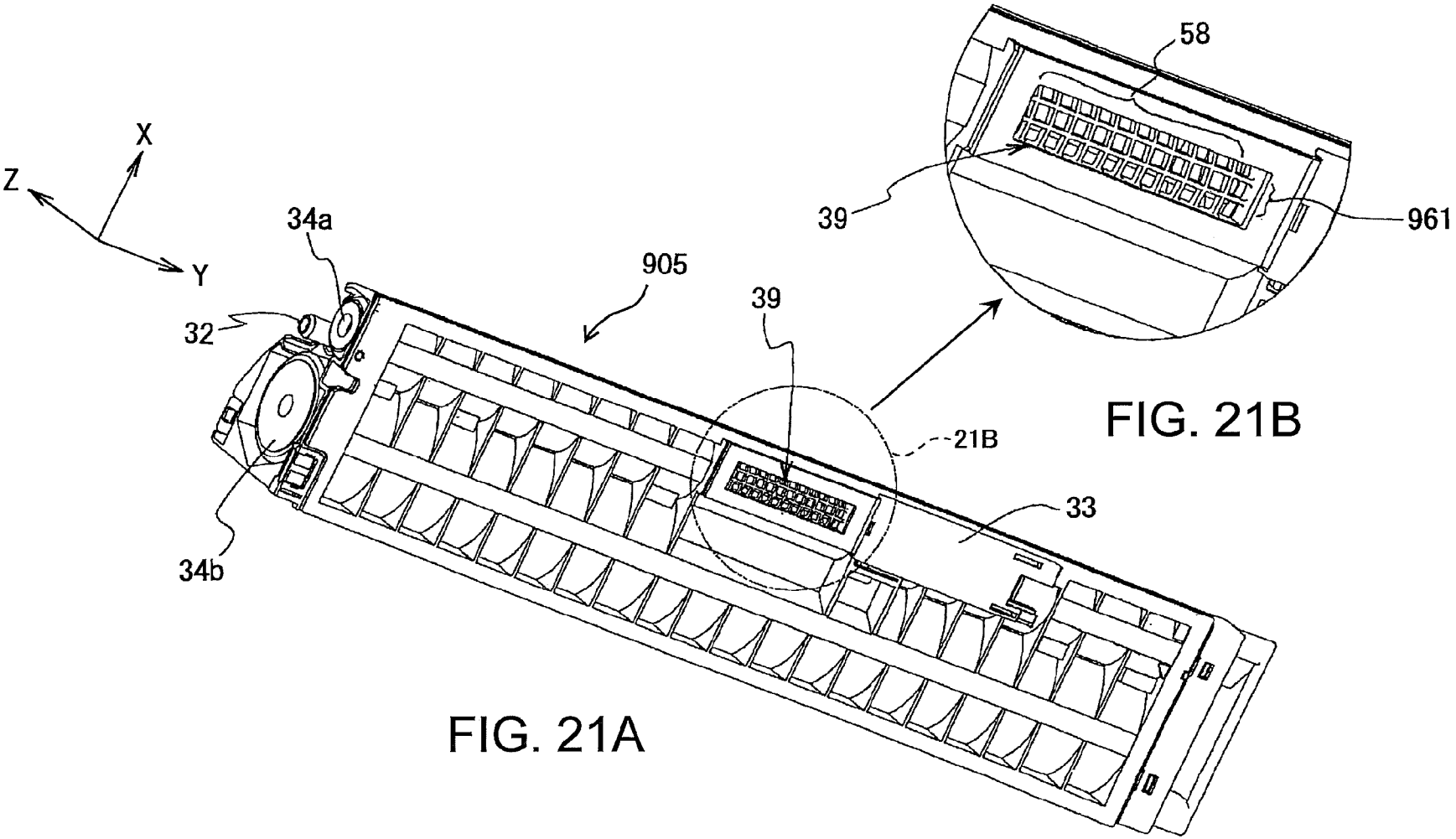
FIG. 21A is a perspective view showing a toner cartridge according to Comparison Example in a state where a toner supplying opening is opened.
FIG. 21B is an enlarged view showing a part surrounded by a dashed line 21B in FIG. 21A.
Figure 23A:
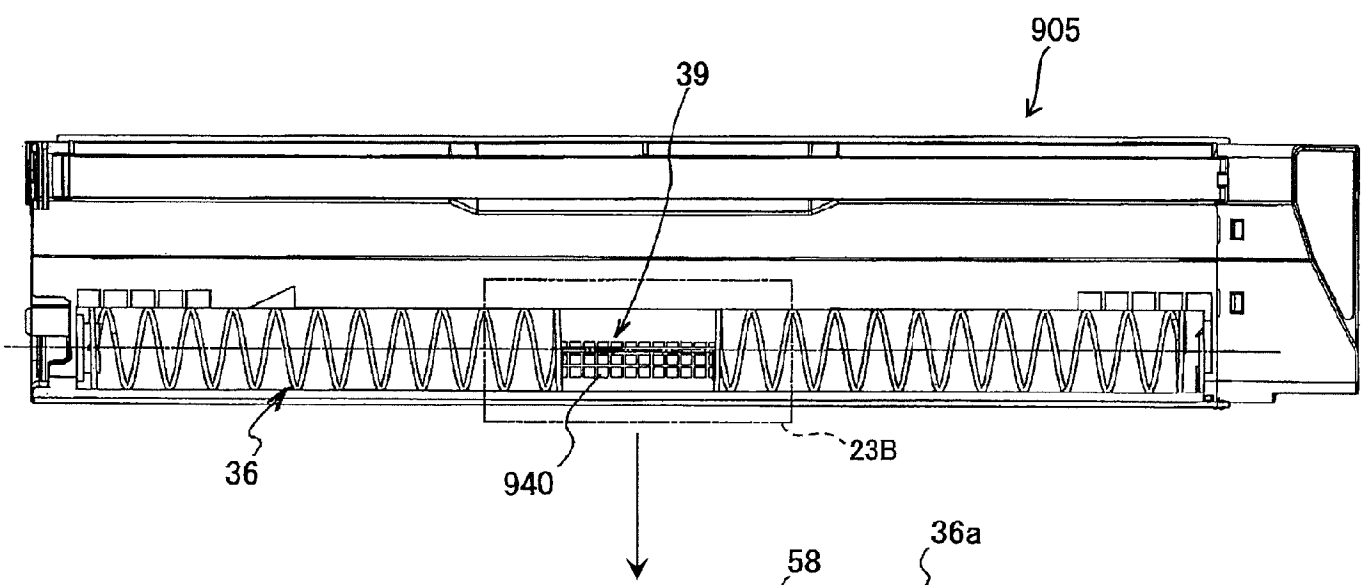
FIG. 23A is a transparent plan view showing the toner cartridge according to Comparison Example.
Figure 23B:
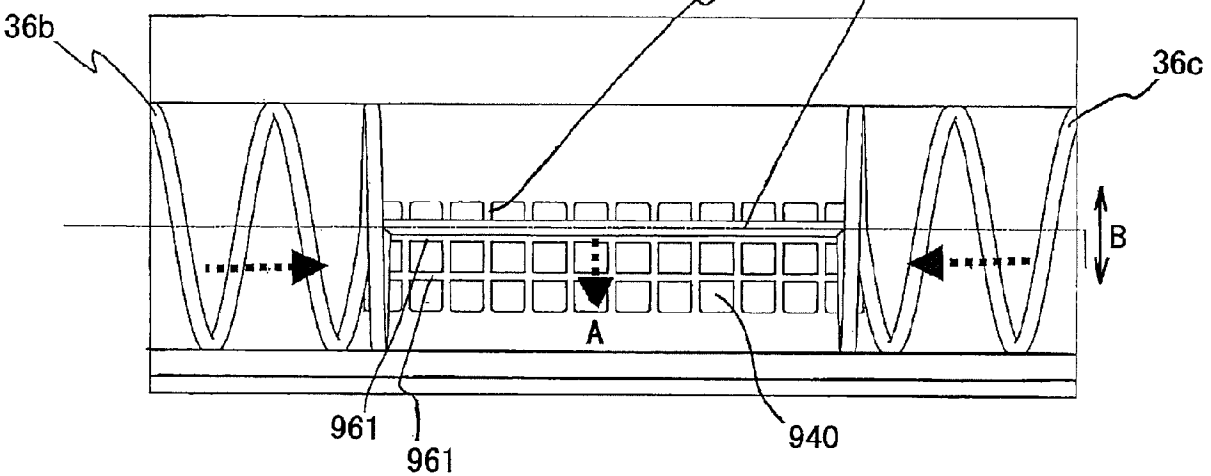
FIG. 23B is an enlarged view showing a part surrounded by a dashed line 23B in FIG. 23A.

FIG. 21A is a perspective view showing the toner cartridge 905 of Comparison Example in a state where the toner supplying opening 39 is opened. FIG. 21B is an enlarged view showing a part surrounded by a dashed line 21B in FIG. 21A. FIG. 22A is a front view showing the toner cartridge 905 of Comparison Example. FIG. 22B is a sectional view showing the toner cartridge 905 taken along line 22B-22B in FIG. 22A. FIG. 22C is an enlarged view showing a part surrounded by a dashed line 22C in FIG. 22B. FIG. 23A is a transparent plan view showing the toner cartridge 905 of Comparison Example. FIG. 233 is an enlarged view showing a part surrounded by a dashed line 23B in FIG. 23A.

The spiral 36 of Comparison Example is the same as the spiral 36 of the toner cartridge 5 of Embodiment 1. The toner supplying opening 39 of Comparison Example has ribs 961 (i.e., referred to as parallel ribs 961) extending in the direction parallel to the rotation axis of the spiral 36, in addition to the ribs 58 extending in the direction perpendicular to the rotation axis of the spiral 36. In the toner supplying opening 39 of Comparison Example, the ribs 961 and ribs 58 cross each other in a lattice manner. The provision of the parallel ribs 961 increases an amount of the toner 4 moving on the parallel ribs 961 among the toner 4 conveyed in the direction of the rotation axis by the left and right spiral portions 36*b* and 36*c*. This leads to the same result as when the opening area of the toner supplying opening 39 decreases.

This results in reduction of the amount of the toner 4 supplied into the toner supplying opening 39 by the gravity of the toner 4 and by the conveying forces of the left and right spiral portions 36*b* and 36*c*. Therefore, a pressure applied to the toner 4 moving toward the toner supplying opening 39 is likely to increase. That is, the agglomeration of the toner 4 may occur.

Further, although the agitating portion 36*a* conveys the toner 4 toward the toner supplying opening 39, lengths of the slits 940 (formed between the ribs 58 and the ribs 961) in the rotating direction of the spiral 36 decrease because of the provision of the parallel ribs 961. Therefore, an amount of the toner 4 conveyed by one rotation of the agitating portion 36*a* decreases. Further, although the toner 4 is pushed through between the agitating portion 36*a* and the ribs 58 and introduced into the toner conveying path 27 through between the ribs 58, the amount of the toner 4 introduced into the toner conveying path 27 (by one rotation of the spiral 36) decreases since gaps between the ribs 58 become smaller because of the provision of the parallel ribs 61.

For this reason, in Embodiment 1, the ribs 58 of the toner supplying opening 39 are arranged at a predetermined interval in the direction of the rotation axis of the spiral 36, and extend perpendicular to the rotation axis of the spiral 36. Further, each slit 40 between the ribs 58 is formed so that the length L1 of the shorter edge is shorter than the length L2 of the longer edge (i.e., the arcuate longer edge). With such a configuration, the toner 4 conveyed by the spiral 36 can be effectively introduced into the toner supplying opening 39, and the agglomeration of the toner 4 (due to the increase in pressure) can be prevented.

Next, a toner cartridge 1005 of Experimental Example will be described. The toner cartridge 1005 of Experimental Example has the toner supplying opening 39 provided with inclined ribs 958. FIG. 16A is a transparent plan view showing the toner cartridge 1005 of Experimental Example. FIG. 16B is an enlarged view showing a part surrounded by a dashed line 16B in FIG. 16A.

The spiral 36 of Experimental Example is the same as the spiral 36 of Embodiment 1. The ribs 958 of the toner supplying opening 39 of Comparison Example extend along the bottom inner circumferential surface 38 (FIG. 14C) of the toner storage portion 31. The ribs 958 are inclined with respect to a circumferential direction B (i.e., the rotating direction) of the spiral 36. To be more specific, the ribs 958 on both sides of a center portion of the toner storage portion 31 are inclined in opposite directions. In this example, the ribs 958 on the left side in FIG. 16B are inclined at −10°, and the ribs 958 on the right side in FIG. 16B are inclined at +10°.

In Experimental Example, a contact length over which the ribs 958 contact the agitating portion 36*a* is larger as compared with a configuration in which the ribs 958 are not inclined. Therefore, the amount of the toner 4 which is loosened by one rotation of the spiral 36 increases. However, a total area of the ribs 958 relative to the opening area of the toner supplying opening 39 increases, and therefore the amount of the toner 4 introduced into the toner supplying opening 39 decreases.

For this reason, in Embodiment 1, the ribs 58 (958) of the toner supplying opening 39 are formed so that inner ends of the ribs 58 (958) extend along the bottom inner circumferential surface 38 (FIG. 14C) of the toner storage portion 31. Further, if the ribs 958 are inclined with respect to the circumferential direction B of the spiral 36 (so that the ribs 958 on both side of the center portion are inclined in opposite directions), the inclination angle of the ribs 958 is preferably in a range of ±5°, and more preferably in a range of ±2°. It is experimentally confirmed that the agglomeration of the toner is prevented at a practically non-problematic level when the inclination angle of the ribs 958 is in these ranges.

Figure 17:
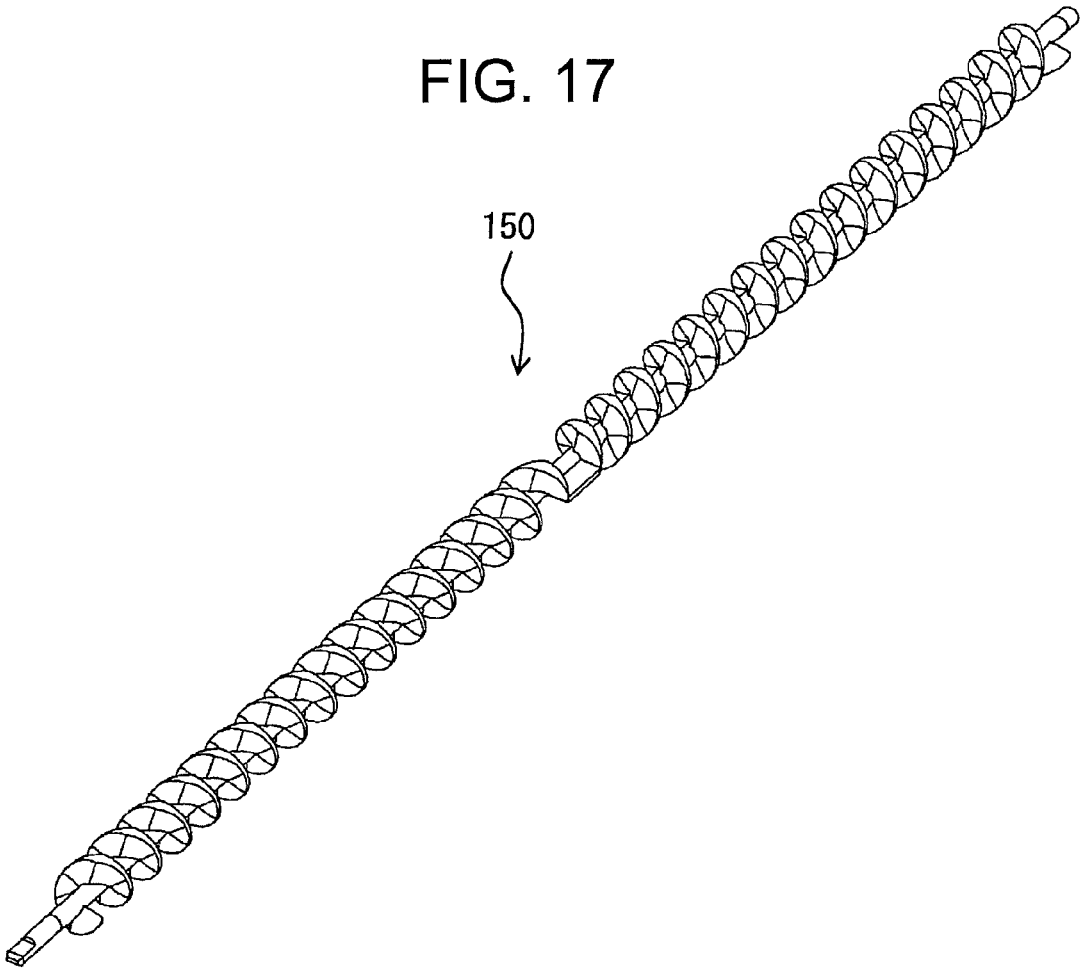
FIG. 17 is a perspective view showing a spiral according to Modification 1 of Embodiment 1.

In Embodiment 1, the spiral 36 is made of the metal wire wound in a spiral shape. However, the spiral 36 is not limited to such a structure. For example, FIG. 17 shows a spiral 150 of Modification 1. The spiral 150 of Modification 1 is in the form of a screw, and is made of, for example, a molding material such as resin.

Figure 18:
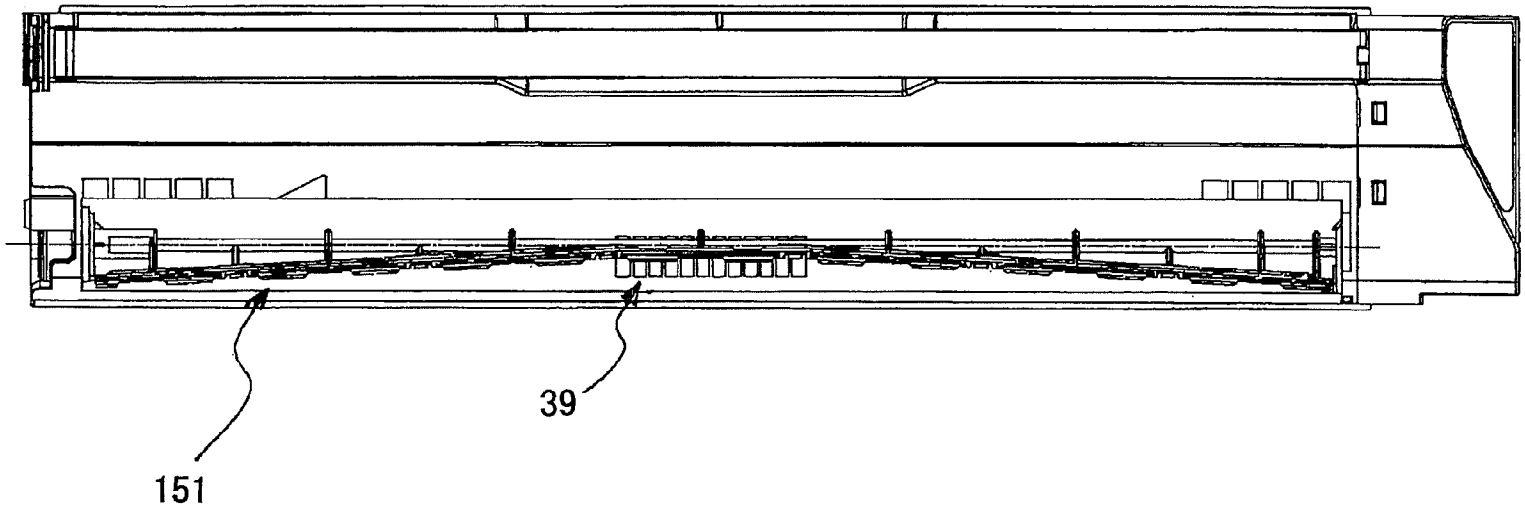
FIG. 18 is a transparent plan view showing a toner cartridge according to Modification 2 of Embodiment 1.
Figure 19:
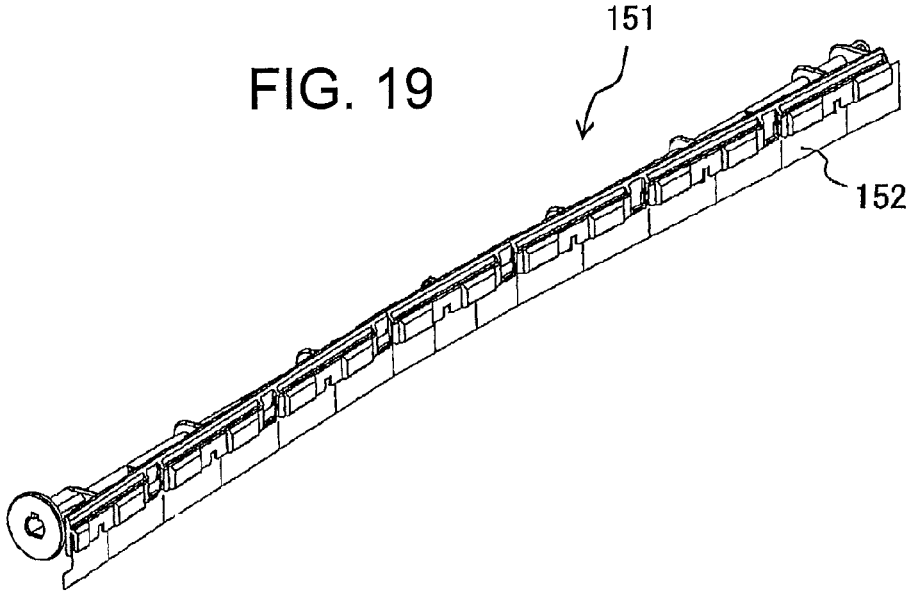
FIG. 19 is a perspective view showing an agitating member according to Modification 2.

FIG. 18 shows a toner cartridge of Modification 2. FIG. 19 is a perspective view showing an agitating member 151 according to Modification 2. In Modification 2, the agitating member 151 is used instead of the spiral 36. The agitating member 151 has a sheet member 152. The sheet member 152 has inclined portions on both sides of a center portion facing the toner supplying opening 39. The inclined portions of the sheet member 152 are inclined with respect to a rotation axis of the agitating member 151. When the agitating member 151 rotates, the sheet member 152 of the agitating member 151 conveys the toner 4 from both sides toward the toner storage opening 39. In Modification 2, the same effects as those of Embodiment 1 can be provided. The sheet member 152 is a flexible member. For example, the sheet member 152 is made of a polyester film, and has a thickness of 0.1 mm.

Figure 20:
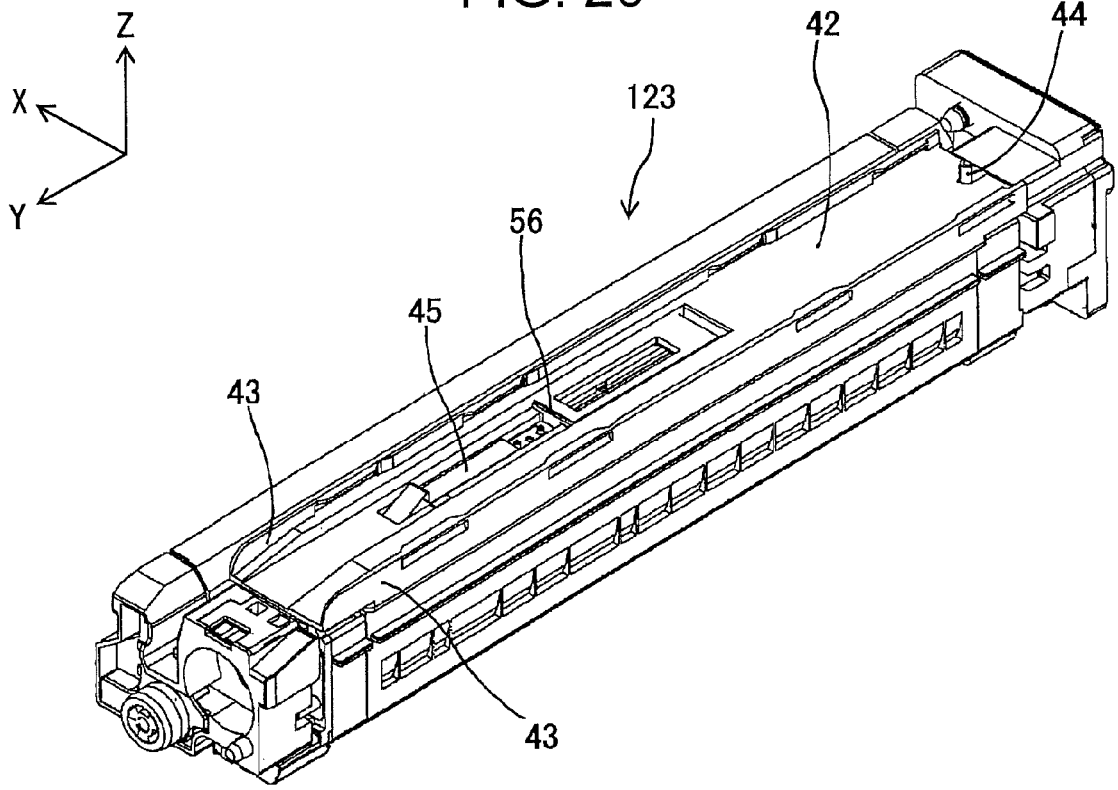
FIG. 20 is a perspective view showing an image forming unit (except a toner cartridge) according to Modification 3 of Embodiment 1.

In Embodiment 1, the toner cartridge holding units 41 are formed as separate bodies from the developing device 10, and are fixed to the printer 100. Further, each toner cartridge holding unit 41 has a function to introduce the toner to the developing device 10 via the toner conveying path 27. However, the present invention is not limited to such a configuration. For example, FIG. 20 shows an image forming unit 123 (except a toner cartridge 5) according to Modification 3. In Modification 3, the image forming unit 123 is provided with function components having the same function as the toner cartridge holding unit 41 except the toner conveying path 27. The function components are directly provided on an upper side of the image forming unit 123, and are integrally formed with the image forming unit 123.

As described above, according to the printer of Embodiment 1, the agglomerated toner is loosened at the toner supplying opening. Therefore, a failure in ejection of the toner (caused by the agglomerated toner) can be prevented, and a toner supplying capacity can be maintained. Further, since the non-agglomerated toner can be supplied to the developing device, a high-quality printing can be achieved. Moreover, since the toner stored in the toner cartridge is loosened, the amount of the toner that remains in the toner storage portion when a lifetime of the toner cartridge expires can be reduced. Therefore, the toner stored in the toner cartridge can be effectively used, and a cost performance is enhanced.

Embodiment 2

Figure 24A:
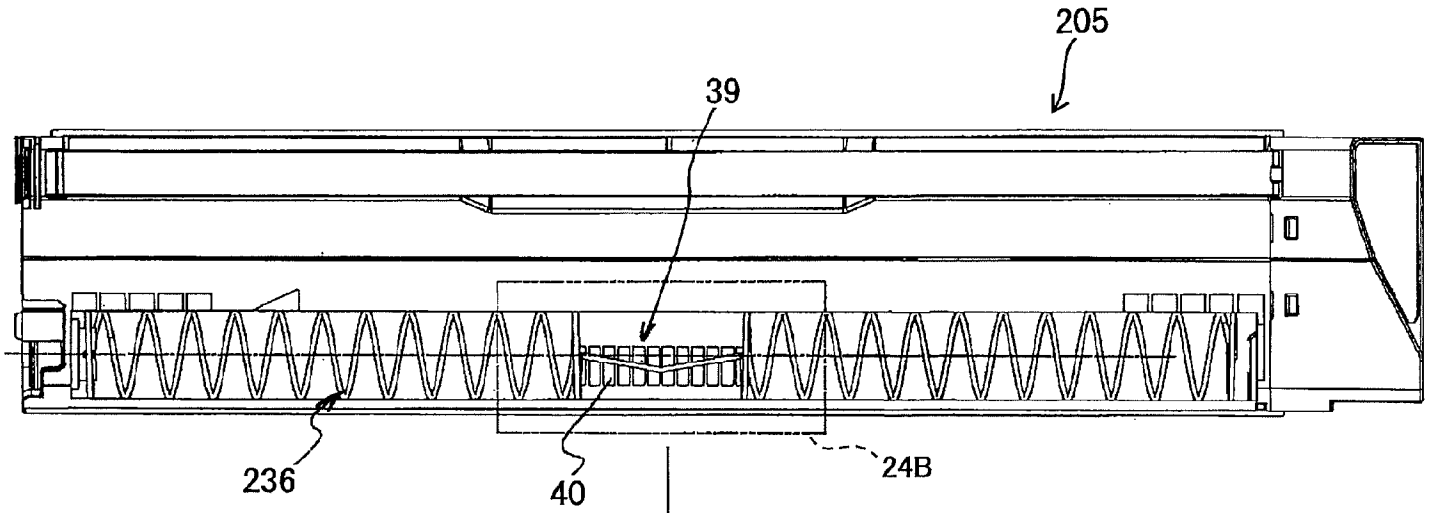
FIG. 24A is a transparent plan view showing a toner cartridge according to Embodiment 2 of the present invention.
Figure 24B:
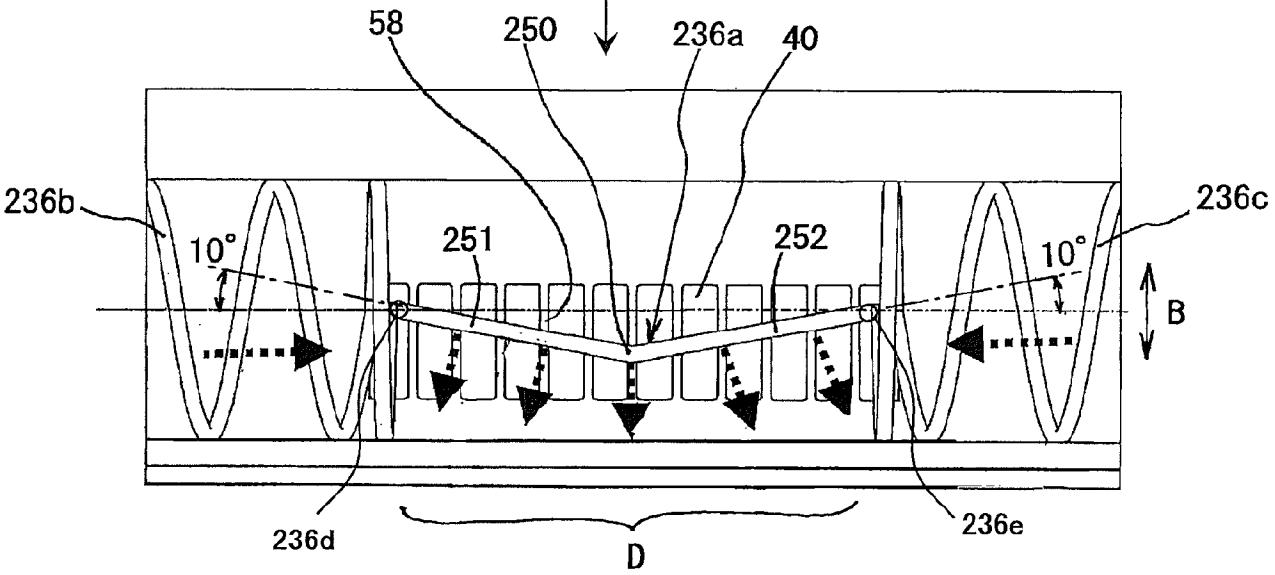
FIG. 24B is an enlarged view showing a part surrounded by a dashed line 24B in FIG. 24A.
Figure 25:
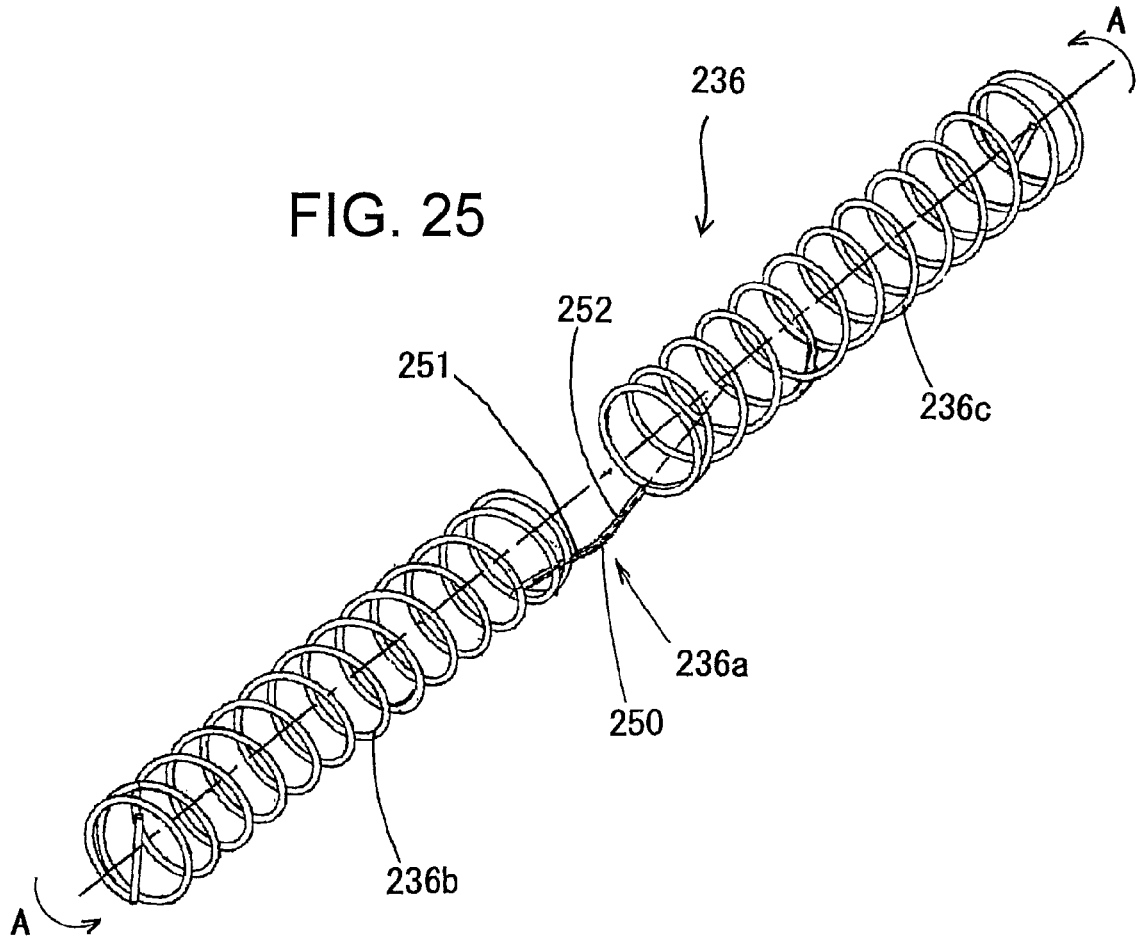
FIG. 25 is a perspective showing a spiral provided in the toner cartridge according to Embodiment 2.

FIG. 24A is a transparent plan view showing a toner cartridge 205 according to Embodiment 2. FIG. 24B is an enlarged view showing a part surrounded by a dashed line 24B in FIG. 24A. FIG. 25 is a perspective showing a spiral 236 provided in the toner cartridge 205 according to Embodiment 2.

The printer with the toner cartridge 205 of Embodiment 2 is different from the printer 100 (FIG. 1) of Embodiment 1 in a shape of a spiral 236. Therefore, components of the printer of Embodiment 2 which are the same as those of the printer 100 of Embodiment 1 are assigned with the same reference numerals, and duplicate explanations will be omitted. Here, explanations will be focused on differences from Embodiment 1. Since the components of the printer of Embodiment 2 except the spiral 236 are the same as those of the printer 100 of Embodiment 1, FIGS. 1 through 15 will be referred as necessary.

The spiral 236 is configured so that two main parts are substantially symmetrical to each other with respect to an imaginary plane at a center portion of the spiral 236 in a longitudinal direction (i.e., the Y direction). An agitating portion 236*a* is formed at a center region of the spiral 236. The agitating portion 236*a* is in the form of a V-shape (i.e., a bent shape), and extends in the substantially longitudinal direction. A left spiral portion 236*b* and a right spiral portion 236*c* extend from both ends of the agitating portion 236*a*. The left spiral portion 236*b* and the right spiral portion 236*c* have spiral shapes. The left spiral portion 236*b* and the right spiral portion 236*c* and are wound in opposite directions.

In FIG. 24B, a portion where the agitating portion 236*a* is connected to the left spiral portion 236*b* is referred to as a left connecting portion 236*d*. A portion where the agitating portion 236*a* is connected to the right spiral portion 236*c* is referred to as a right connecting portion 236*e*.

The agitating portion 236*a* includes a left half part 251 and a right half part 252. The left half part 251 extends from the left connecting portion 236*d* at a predetermined angle (for example, 10°) with respect to a straight line parallel to the rotation axis of the spiral 236. The straight line is defined on a tangent plane that contacts an imaginary cylindrical surface whose diameter is the same as an outer diameter of the spiral 236 and also contacts the left connecting portion 236*d*. The right half part 252 extends from the right connecting portion 236*e* at a predetermined angle (for example, 10°) with respect to a straight line parallel to the rotation axis of the spiral 236. The straight line is defined on a tangent plane that contacts the imaginary cylindrical surface whose diameter is the same as an outer diameter of the spiral 236 and also contacts the right connecting portion 236*e*. The left half part 251 and the right half part 252 are connected at a center point 250 of the agitating portion 236*a* in the form of a V-shape that protrudes in the rotating direction (shown by an arrow A in FIG. 24B) of the spiral 236.

Further, the left half part 251 and the right half part 252 of the agitating portion 236*a* have curved shapes along the imaginary cylindrical surface whose diameter is the same as an outer diameter of the spiral 236. Therefore, the spiral 236 has a shape in which the main parts are substantially symmetrical to each other with respect to an imaginary plane passing through the center point 250 of the agitating portion 236*a* and perpendicular to the rotation axis. In this regard, the inclination angle of each of the left and right half parts 251 and 252 is not limited to 10°. It is preferred that the inclination angle each of the left and right half parts 251 and 252 is less than or equal to 10°

An operation of the toner cartridge 205 of Embodiment 2 will be described.

As was described in Embodiment 1 with reference to FIG. 14B, the toner 4 stored in the toner storage portion 31 of the toner cartridge 205 is conveyed toward the spiral 236 by the rotation of the agitating member 35 in the direction shown by the arrow C (FIG. 14B). The toner 4 is then conveyed toward the toner storage opening 39 by the left spiral portion 236*b* and the right spiral portion 236*c* of the spiral 236 rotating in the direction shown by the arrow A in FIG. 25. In this state, a conveying direction of the toner 4 is the same as the direction of the rotation axis of the spiral 236.

Since the toner supplying opening 39 extends downward, the toner 4 conveyed by the spiral 236 to the vicinity of the toner storage opening 39 is introduced into the toner supplying opening 39 by gravity of the toner 4 or by conveying forces of the left and right spiral portions 236*b* and 236*c*. The toner 4 which has not been introduced into the toner supplying opening 39 is moved by the agitating portion 236*a* in directions shown by arrows D inclined to the left side and the right side at the predetermined angles (for example, 10°) with respect to the rotating direction of the spiral 36. The agitating portion 236*a* agitates the toner 4 by changing the conveying direction of the toner 4. The agitating portion 236*a* rotates in proximity to or in contact with an inner circumferential surface of the toner storage portion 31, and conveys the toner 4 toward the toner supplying opening 39.

As the spiral 236 rotates to convey the toner 4 toward the toner storage opening 39, the toner 4 of an excessive amount may be collected at the toner supplying opening 39. In such a case, a pressure applied to the toner 4 may increase, and a part of the toner 4 may be agglomerated. However, in Embodiment 2, the ribs 58 provided in the toner supplying opening 39 prevents agglomeration of the toner 4.

As shown in FIGS. 14C and 15B, the ribs 58 are provided along the inner circumferential surface of the toner storage portion 31. Further, the ribs 58 extend in a direction almost perpendicular to (i.e., at an angle of 80° with respect to) the agitating portion 236*a* that moves in proximity to or in contact with the inner circumferential surface of the toner storage portion 31. Therefore, when the agitating portion 236*a* rotates to convey the toner 4 toward the toner supplying opening 39, the agitating portion 236*a* rotates in proximity to or in contact with the ribs 58. That is, the agitating portion 236*a* loosens the agglomerated toner and conveys the toner into the toner supplying opening 39 via the slits 40. The toner 4 introduced into the toner storage opening 39 passes the toner conveying path 27, and is stored in the toner reservoir 112 of the developing device 10 (FIG. 2). Since the agglomerated toner 4 is loosened at the toner supplying opening 39 of the toner cartridge 5, the non-agglomerated toner is stably supplied to the developing device 10.

Further, in Embodiment 2, the left half part 251 and the right half part 252 of the agitating portion 236*a* are inclined at the predetermined angle (in this example, 10°) in opposite directions as shown in FIG. 24B. Therefore, a contact length over which the rib 58 of the toner storage portion 31 contact the agitating portion 236*a* becomes larger as compared a configuration in which the left and right half parts 251 and 252 are not inclined. Therefore, the amount of the toner 4 loosened by one rotation of the spiral 236 increases. In this regard, the inclination angle of each of the half parts 251 and 252 is not limited to 10°. It is preferred that the inclination angle of each of the half parts 251 and 252 is less than or equal to 10°. It is experimentally confirmed that the agglomeration of the toner is prevented at a practically non-problematic level when the inclination angle is in this range.

Moreover, when the agitating portion 236*a* rotates in proximity to or in contact with the ribs 58, the toner 4 moving on the rib 58 is pushed into the slits 40 (between the ribs 58) by the agitating portion 236*a*. Therefore, the toner 4 is efficiently supplied to the toner supplying opening 39. That is, the amount of the toner supplied by one rotation of the spiral 236 increases.

In Embodiment 2, the left and right half parts 251 and 252 of the agitating portion 236*a* are connected at the center point 250 in the form of a V-shape (i.e., a bent shape) that protrudes in the rotating direction as shown by the arrow A in FIG. 25. However, the present invention is not limited to such a configuration. For example, FIGS. 26A and 26B are a perspective view and a front view showing a spiral 336 according to Modification 4. The spiral 336 of Modification 4 has an agitating portion 336*a* including left and right half parts 251 and 252. The left and right half parts 251 and 252 are connected in the form of a V-shape (i.e., a bent shape) that protrudes in a direction opposite to the rotating direction (shown by the arrow A). It is preferred that the inclination angle of each of the half parts 251 and 252 is less than or equal to 10°.

Figure 28A:
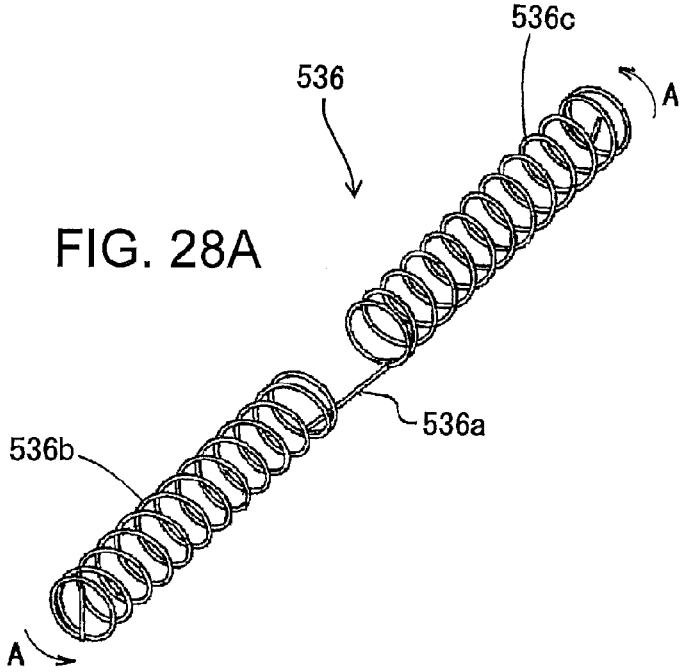
FIGS. 28A and 28B are a perspective view and a front view showing a spiral according to Modification 6 of Embodiment 2.
Figure 28B:
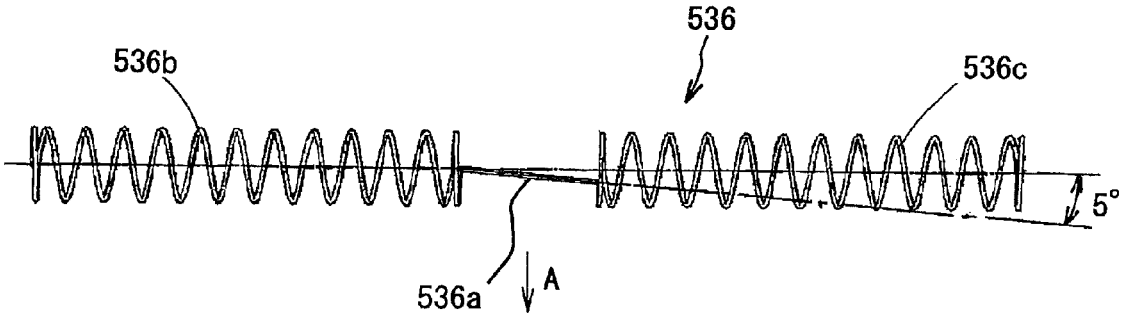

Further, FIGS. 27A and 27B are a perspective view and a front view showing a spiral 436 according to Modification 5. The spiral 436 of Modification 5 has an agitating portion 436*a* which is inclined as a whole at a predetermined angle (for example, 5°) in one direction. FIGS. 28A and 28B are a perspective view and a front view showing a spiral 536 according to Modification 6. The spiral 536 of Modification 6 has an agitating portion 536*a* which is inclined as a whole at a predetermined angle (for example, 5°) in a direction opposite to the agitating portion 436*a* of Modification 5.

Regarding Modifications 5 and 6, the "inclination angle" indicates, for example, an angle between the connecting portion at which the agitating portion and the left spiral portion are connected and a straight line parallel to the rotation axis of the spiral. The straight line is defined on a tangent plane that contacts an imaginary cylindrical surface whose diameter is the same as the outer diameter of the spiral and also contacts the left connecting portion. Further, the agitating portion is formed along the imaginary cylindrical surface whose diameter is the same as the outer diameter of the spiral. The inclination angle is not limited to 5°. The inclination angle is preferably less than or equal to 5°. It is experimentally confirmed that the agglomeration of the toner is prevented at a practically non-problematic level when the inclination angle is in this range.

As described above, according to Embodiment 2 of the present invention, the agitating portion of the spiral is inclined at the predetermined angle. Therefore, an ability to loosen the agglomerated toner and a toner supplying capacity can be enhanced. Accordingly, it becomes possible to prevent image blurring (caused by insufficient supplying of the toner) or other image failure, and to achieve a high-quality printing. Further, as the toner supplying capacity increases, a time 10, period over which the toner stays in the toner cartridge becomes shorter. Therefore, an increase in pressure applied to the toner in the vicinity of the toner storage opening can be suppressed, and the agglomeration of the toner can be retarded. As a result, the printing quality can be maintained for a long time.

In the above described embodiments, the color electrophotographic printers have been described as examples of the image forming apparatus. However, the present invention is also applicable to other type of image forming apparatus such as a copier, a facsimile machine or an MFP (Multi-Function Peripheral). Further, the present invention is also applicable to an image forming apparatus (for example, a monochrome printer) that forms a monochrome image.

While the preferred embodiments of the present invention have been illustrated in detail, it should be apparent that modifications and improvements may be made to the invention without departing from the spirit and scope of the invention as described in the following claims.

What is claimed is:

1. A developer storage body, comprising:

a storage portion in which a developer is stored;

an opening through which the developer is ejected; and a conveying member provided in the storage portion, the conveying member being rotatable about a rotation axis so as to convey the developer to the opening, wherein the opening includes a plurality of slits extending in a direction substantially perpendicular to the rotation axis of the conveying member, wherein a length L1 of each slit in a direction of the rotation axis, a length L2 of each slit in a direction perpendicular to the rotation axis and along a circumference of the storage portion, and an interval d between adjacent slits in the direction of the rotation axis satisfy the following relationship:

$d<L1<L2$.

2. The developer storage body according to claim 1, wherein the slits are formed by a plurality of ribs formed along an inner wall surface of the storage portion, and wherein the ribs extend a direction substantially perpendicular to the rotation axis of the conveying member, and are arranged at predetermined intervals in a direction of the rotation axis of the conveying member.

3. The developer storage body according to claim 1, wherein the conveying member includes a conveying portion that conveys the developer in a direction of the rotation axis, and an agitating portion that conveys the developer in a rotating direction of the conveying member.

4. The developer storage body according to claim 3, wherein the conveying portion has a spiral shape.

5. The developer storage body according to claim 1, wherein the conveying member is formed of a metal wire.

6. An image forming unit comprising:

the developer storage body according to claim 1.

7. An image forming apparatus comprising:

the image forming unit according to claim 6.

8. A developer storage body, comprising:

a storage portion in which a developer is stored;

an opening through which the developer is ejected; and a conveying member provided in the storage portion, the conveying member being rotatable about a rotation axis so as to convey the developer to the opening, wherein the opening includes a plurality of slits extending in a direction substantially perpendicular to the rotation axis of the conveying member, wherein the conveying member includes a conveying portion that conveys the developer in a direction of the rotation axis, and an agitating portion that agitates the developer in a rotating direction of the conveying member, wherein the conveying member is symmetrical with respect to an imaginary plane perpendicularly intersecting a center portion of the conveying member in a longitudinal direction of the conveying member, wherein the agitating portion is bent at the center portion of the conveying member in the longitudinal direction; and wherein the conveying member is formed of a metal wire.

9. The developer storage body according to claim 8, wherein the slits are formed by a plurality of ribs formed along an inner wall surface of the storage portion, and wherein the ribs extend a direction substantially perpendicular to the rotation axis of the conveying member, and are arranged at predetermined intervals in a direction of the rotation axis of the conveying member.

10. The developer storage body according to claim 8, wherein the conveying portion has a spiral shape.

11. An image forming unit comprising:

the developer storage body according to claim 8.

12. An image forming apparatus comprising:

the image forming unit according to claim 11.

* * * * *